US005152653A

United States Patent [19]

Matsuo et al.

[11] Patent Number: 5,152,653

[45] Date of Patent: Oct. 6, 1992

[54] SHEET BINDER

[75] Inventors: Kazuhiro Matsuo, Tokyo; Kimiaki Hayakawa; Koichi Murakami, both of Yokohama; Yoichi Tagawa, Ushiku; Kenichi Iizumi, Ibaraki, all of Japan

[73] Assignees: Canon Kabushiki Kaisha; Daiichi Seiki Kogyo Kabushiki Kaisha, both of Tokyo, Japan

[21] Appl. No.: 500,412

[22] Filed: Mar. 28, 1990

[30] Foreign Application Priority Data

| | | | |
|---|---|---|---|
| Mar. 31, 1989 | [JP] | Japan | 1-81119 |
| Apr. 7, 1989 | [JP] | Japan | 1-89454 |
| Apr. 10, 1989 | [JP] | Japan | 1-90371 |
| Jul. 19, 1989 | [JP] | Japan | 1-188291 |

[51] Int. Cl.[5] ..... B42C 13/00

[52] U.S. Cl. ..... 412/11; 412/12; 412/14

[58] Field of Search ..... 412/11, 12, 14, 1, 9

[56] References Cited

U.S. PATENT DOCUMENTS

| | | | |
|---|---|---|---|
| 3,793,660 | 2/1974 | Sims | 11/1 |
| 4,320,547 | 3/1982 | Stolle et al. | 11/1 |
| 4,965,629 | 10/1990 | Hiroi et al. | 355/50 |

FOREIGN PATENT DOCUMENTS

| | | |
|---|---|---|
| 0120997 | 10/1984 | European Pat. Off. . |
| 920508 | 3/1963 | United Kingdom . |

*Primary Examiner*—Timothy V. Eley
*Assistant Examiner*—Willmon Fridie, Jr.
*Attorney, Agent, or Firm*—Fitzpatrick, Cella, Harper & Scinto

[57] ABSTRACT

A sheet binding apparatus includes a tray for supporting a set of sheet materials; a punch for punching the sheet materials on the supporting tray; a conveyor for conveying the sheet materials punched by the punch; a binder for binding the sheet materials conveyed and by the conveyer; a controller for sequentially controlling the punch, the conveyor and the binder.

18 Claims, 30 Drawing Sheets

SHEET BINDER

FIELD OF THE INVENTION AND RELATED ART

The present invention relates to a sheet binder, and more particularly to a ring type sheet binder wherein sheets are punched, and the punched sheets are automatically bound by a binding ring member.

In a conventional ring binder wherein punched sheet materials are bound by a binding ring made of plastic resin comprising a spine and a number of inwardly curved fingers, the sheet materials are punched by a punching means including dies and punches, and thereafter, the sheet materials are taken out of the punching means, and the punched sheet materials are bound at another place.

Since the punched sheet materials are taken out of the punching means, and they are bound at another position, the binding operation is time-consuming, and expertise is required to bind the sheet materials with the ring member.

SUMMARY OF THE INVENTION

Accordingly, it is a principal object of the present invention to provide a sheet binding apparatus that is easy to operate.

According to an aspect of the present invention, there is provided a sheet binding apparatus including punching means for punching sheet materials and binding means for binding the punched sheets, and further comprising conveying means for conveying the sheet materials punched by said punching means to said binding means, and interrelating means for interrelatedly operating said punching means, said conveying means and said binding means. In this apparatus, a binding member is set in the binding means, and the sheet materials are set in the punching means. Then, the sheet materials are automatically punched and bound, and therefore, the operation is not time-consuming, and the punching operation is easy without necessity of specific expertise.

According to another aspect of the present invention, the binding apparatus further comprises switching means for releasing the action of said interrelating means to permit independent operation of said punching means and said binding means. In this apparatus, the punching and binding operations can be carried out independently, and therefore, it is easy to add sheet materials or to interchange sheet materials.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 27A illustrates the sheet conveyance. FIG. 27B illustrates the state when the bound sheets are taken out.

DESCRIPTION OF THE PREFERRED EMBODIMENTS

Preferred embodiments of the present invention will be described in conjunction with the accompanying drawings.

Figure 1:
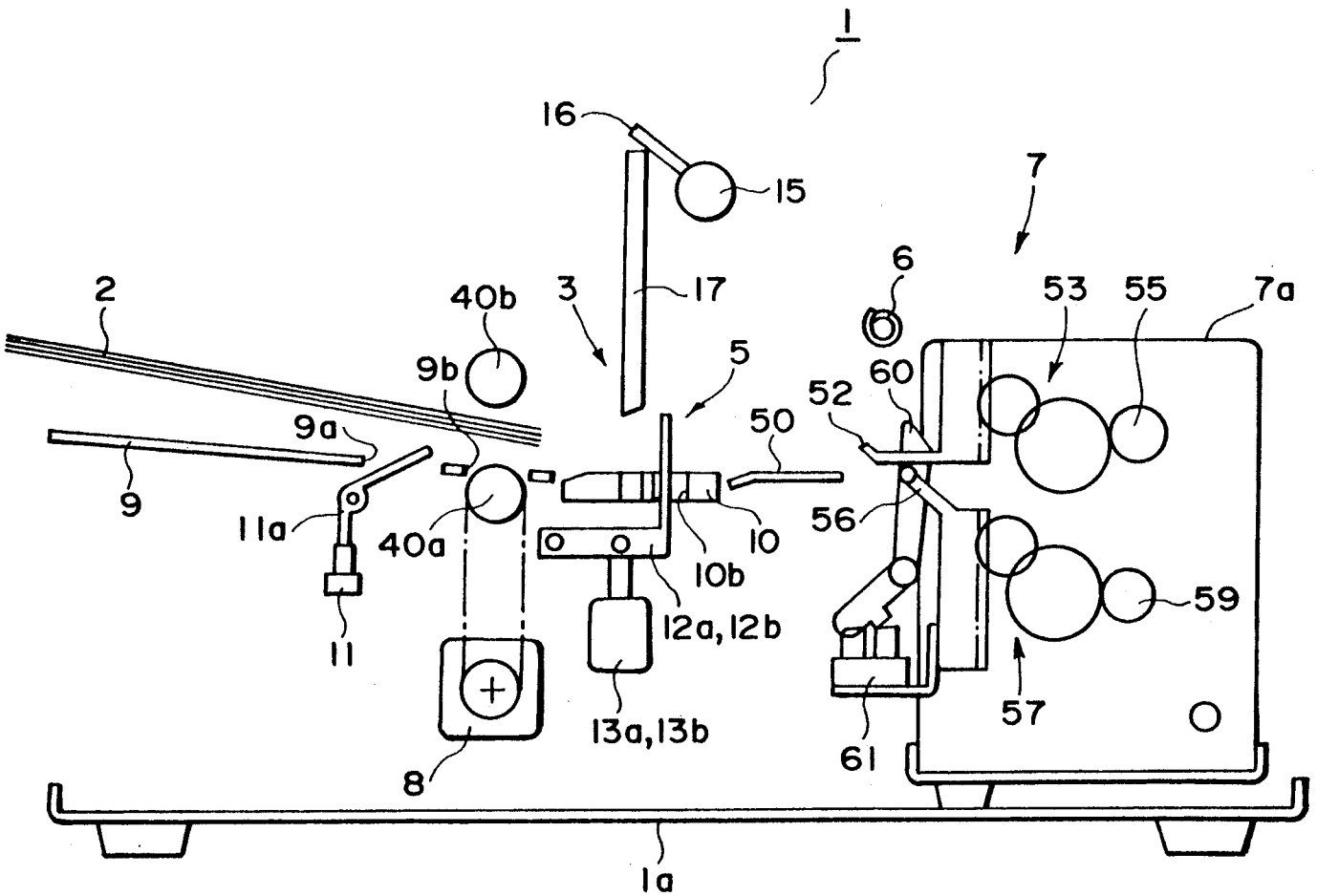
FIG. 1 is a sectional view of a binding apparatus according to an embodiment of the present invention.

Referring to FIG. 1, the sheet binding apparatus 1 according to the first embodiment comprises a punching station 3 for punching a set of sheet materials or sheets 2, a conveyer 5 for conveying the punched sheets 2 and a ring opening station 7 for opening and closing a binding ring 6 for binding the sheets 2 conveyed thereto. They are mounted on a bed 1*a* of the apparatus 1.

Figure 4:
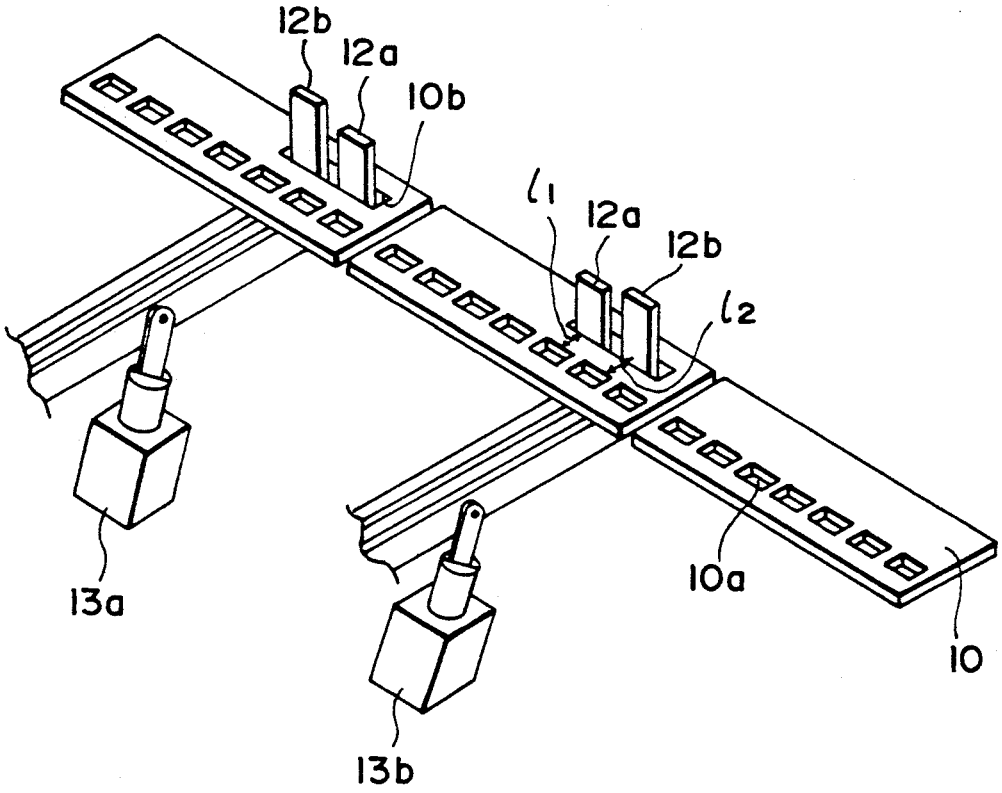
FIG. 4 perspective view of a die and a stopper.

Referring to FIGS. 1, 4, 5, 6, 7 and 8, the punching station 3 will be described. As shown in FIG. 1, a die 10 is disposed close to a sheet supporting tray 9. The supporting tray 9 is provided with a sensor hole 9*a* and a roller hole 9*b*. In the sensor hole 9*a*, a sensor lever 11*a* for detecting presence of the sheet material 2 is disposed. Below the sensor lever 11*a* a sensor 11 is disposed to detect the presence of the sheets 2 in response to the movement of the sensor lever 11*a*. As shown in FIG. 4, the die 9 has a number of square die holes 10*a* aligned in a line and two through holes 10*b* at a position downstream of the holes 10*a* with respect to the direction of the sheet conveyance which will be described hereinafter. Through the holes 10*b*, a pair of short stoppers 12*a* and a pair of long stoppers 12*b* for abutment with edges of the sheets 2 are retractable to align the sheets 2. The stoppers 12*a* constituting the pair are integrally connected, and also, the stoppers 12*b* constituting the pair are integrally connected. The stoppers 12*a* and 12*b* are coupled with solenoids 13*a* and 13*b*, respectively. The solenoids 13*a* and 13*b* lower the associated stoppers when it is deenergized, and raise them when it is energized. The distances $l_1$ and $l_2$ between the holes 12*a* and the stoppers 12*a* and 12*b* satisfy $l_1 < l_2$.

Figure 5:
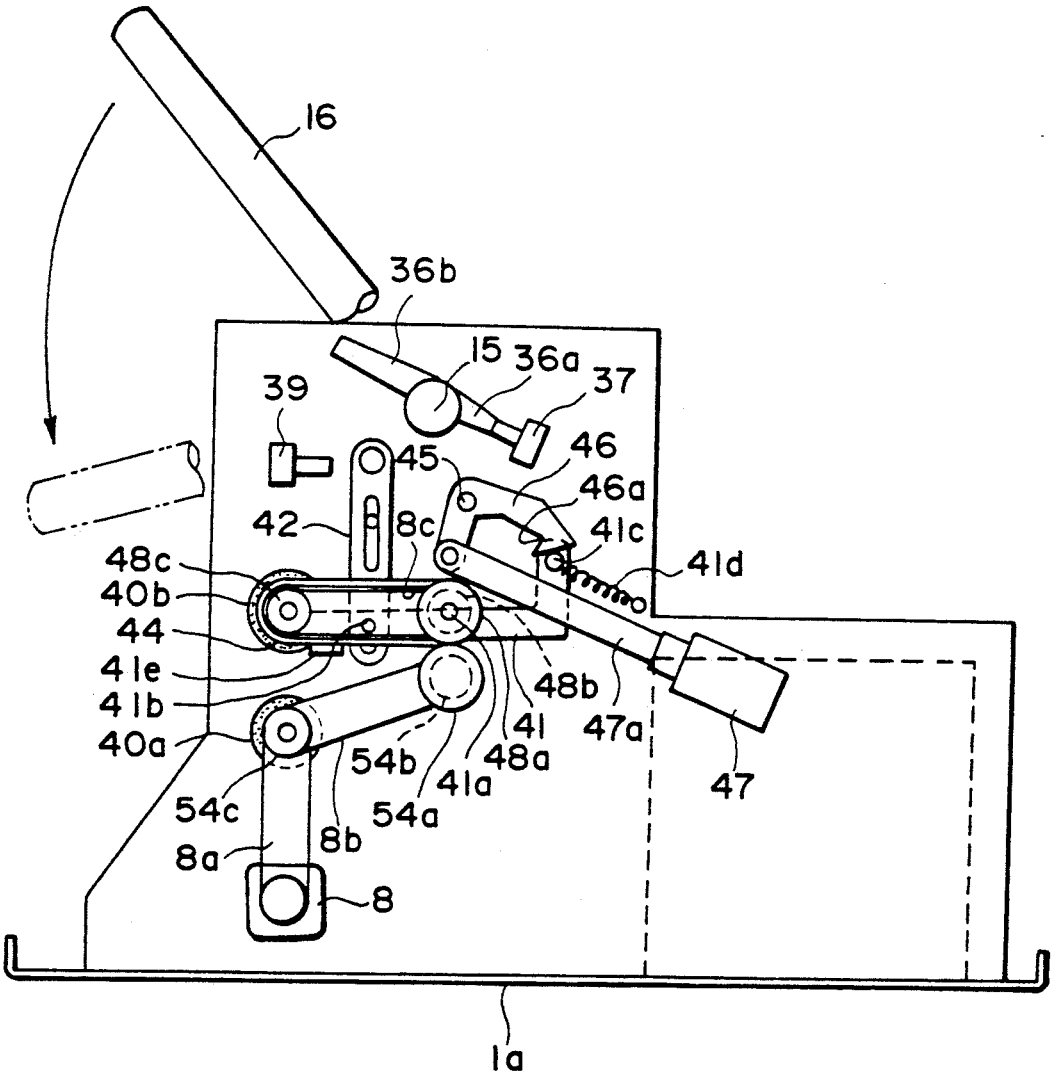
FIG. 5 is a side view of a punching station.
Figure 6:
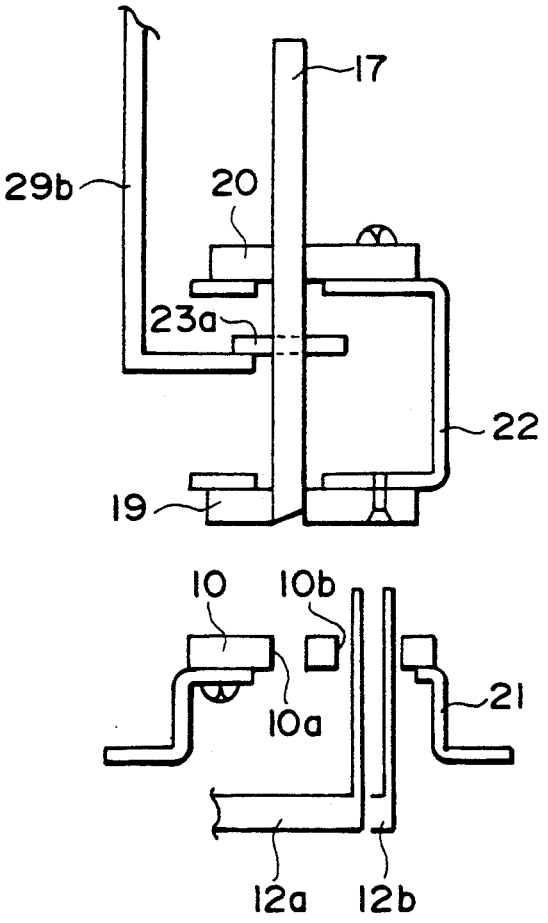
FIG. 6 is an enlarged side view illustrating a relation among the die puncher and a stopper.

As shown in FIGS. 1, 5 and 6, an operating lever 16 has a shaft 15. When it is rotated in the counterclockwise direction, the puncher 17 is lowered along guides 19 and 20 to penetrate through the holes 10*a* of the die 10 which will be described hereinafter.

Figure 7:
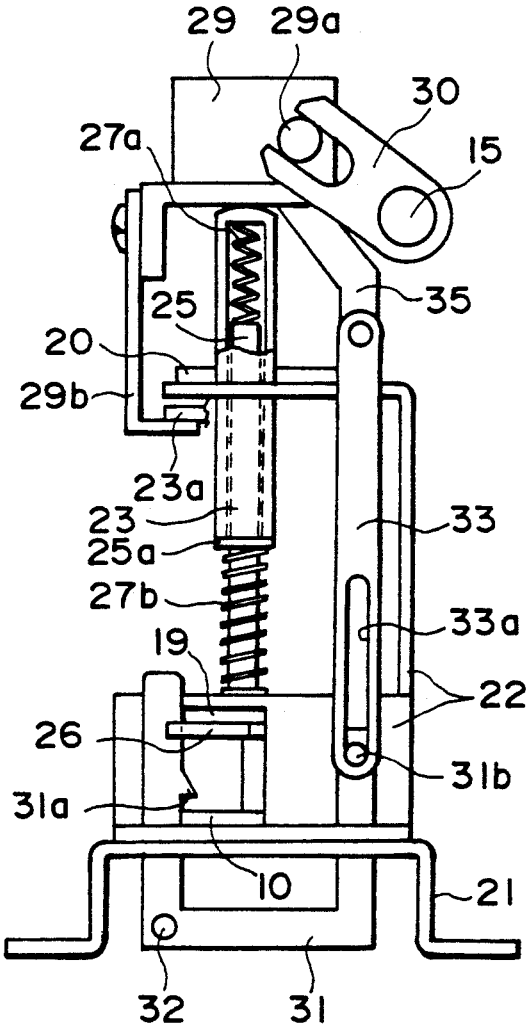
FIG. 7 is a side view of a sheet confining mechanism.
Figure 8:
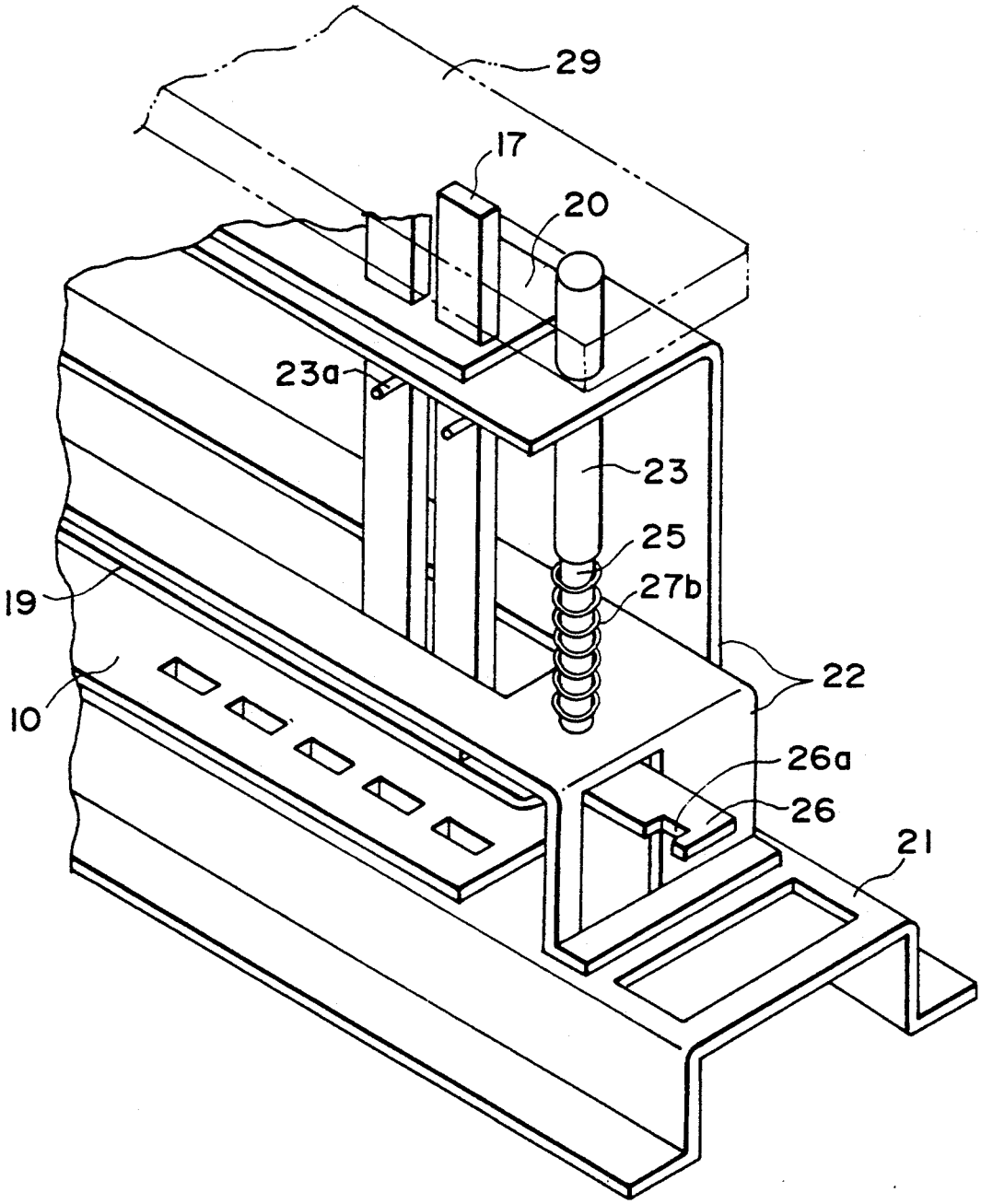
FIG. 8 is an enlarged perspective view of the sheet confining mechanism of FIG. 7.

As shown also in FIGS. 7 and 8, the die 10 is fixed on a die base 21. The guides 19 and 20 are fixedly mounted on a supporting frame 22 which is fixed to the die base 21. At upper portions adjacent longitudinally opposite ends of the supporting frame 22, there are sleeves 23, and punching rods 25 in telescopic relation therewith. The bottom of the pushing rods 25 are fixedly mounted to a confining plate 25. Between each of the sleeves 23 and an upper end of the associated pushing rod 25, a compression spring 27*a* is mounted, and between a flange 25*a* of each of the pushing rods 25 and the supporting frame 22, a compression coil spring 27*b* is mounted around the pushing rod 25. A pressing arm 29 is mounted on the top end of the punches 17, and it pushes the sleeve 23 downwardly. The pressing arm 29 is provided with longitudinal end projections 29*a* which are engaged with lever arms 30, which in turn are fixedly mounted to the ends of the shaft 15. When the lever 16 (FIGS. 1 and 5) is rotated in the clockwise direction, the pressing arm 29 lowers. Each of the punches 17 has a projection 23*a* which abuts a limiter 29*b* mounted on the pressing arm 29. The confining plate 26 has a cut-away portion 26*a* with which a locking plate 31, which has a generally hook shape, engages. The locking plate 31 has a pawl 31*a* in its vertical portion. The bottom of the vertical portion is rotatably supported on a pin 32, and another vertical portion of the locking plate 31 has adjacent its upper end a projection 31*b* which is engaged with an elongated slot 33*a* of a releasing link 33. An upper portion of the releasing link 33 is rotatably supported on an arm 35 downwardly extended from the pressing arm 29, so that the pressing arm 26 is confined or released by the pawl 31*a* of the locking plate 31.

As shown in FIG. 5, sensor levers 36*a* and 36*b* are rotatable together with the lever 16. An upper sensor 37 and a lower sensor 37 are faced to the sensor lever 36*a* when it is at its upper position, and faced to the sensor lever 36*b* when it is at its lower position, respectively.

Figure 9:
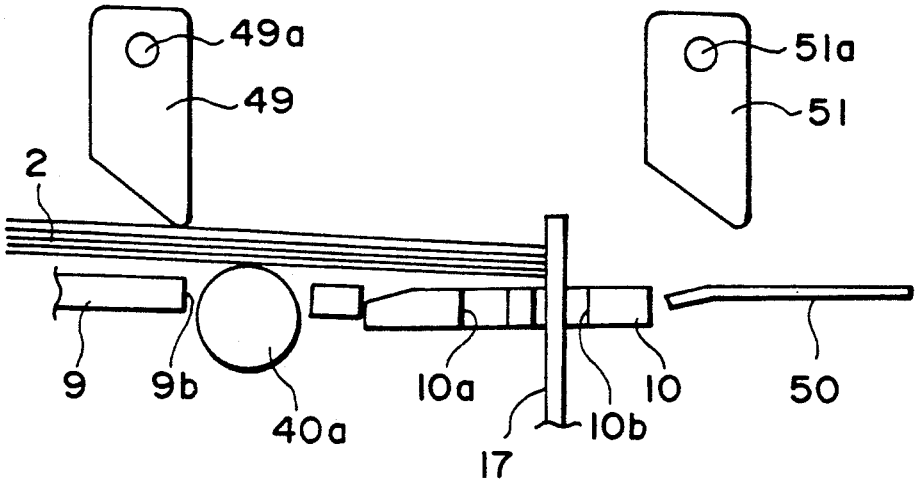
FIG. 9 is a side view of a conveyer.
Figure 10:
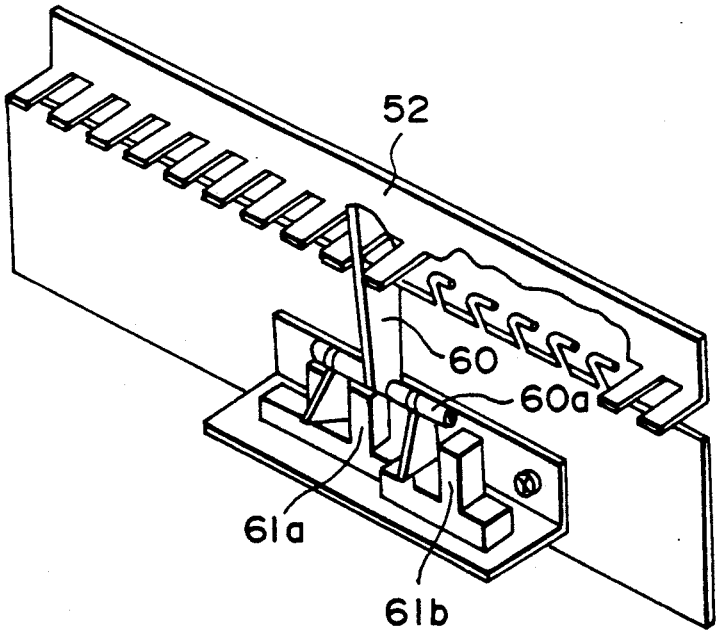
FIG. 10 is a perspective view illustrating upper and lower pawls.
Figure 11:
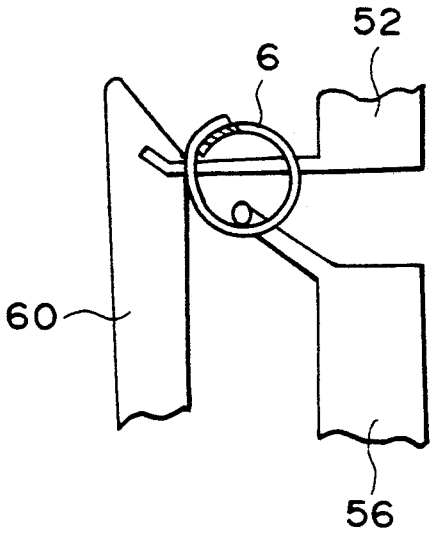
FIG. 11 is a side view illustrating a binding member set in the upper pawl.

Referring to FIGS. 1, 5 and 9, the conveyer 5 will be described. A conveying roller 40*a* which is driven by a motor 8 mounted rotatably on the apparatus 1 is projected through the roller hole 9*b* of the sheet supporting tray 9. A pick-up lever 41 is rotatably supported on a pin 41*a* fixedly mounted on the apparatus at its intermediate position. A lower end portion of the pick-up arm 42 is rotatably mounted on the lever 41 by a pin 41*b* at a left side of the pin 41*a*. A right end of a lever 44 is rotatably supported on the lever 41. To the left end of the lever 44, an upper conveying roller 40*b* is rotatably supported. On the right end of the lever 44, a gear 48*a* and a pulley 48*b* coaxially integral with the gear 48*a* are rotatably supported. A pulley 54*b* is coaxially integral with a gear 54*a* which is in meshing engagement with the gear 48*a*. A pulley 54*c* is coaxial with and integral with the lower conveying roller 41*a*. A pulley 48*c* is coaxial and integral with the upper conveying roller 41*b*. Belts 8*a*, 8*b* and 8*c* are trained around a pulley of the motor 8 and the pulley 54*c*, around the pulley 54*c* and the pulley 54*b*, around the pulley 48*b* and the pulley 48*c*, respectively. By the rotation of the motor 8 in the clockwise direction, the upper and lower conveying rollers 40*a* and 40*b* grip the sheet materials 2 and convey them rightwardly. A tension spring 41*d* is mounted to the lever 41, so that the lever 41 is normally urged in the clockwise direction about the pin 41*a*, and 50 that the arm 42 is normally urged upwardly through the pin 41*b*. A vertical portion of the lever 41 is provided with a projection 41*c*, which is engageable with an engaging portion 46*a* of a hook 46 rotatably supported on a pin 45 fixed on the apparatus. The other end of the hook 46 is rotatably supported at an end of a core rod 47*a* of a solenoid 47. When the solenoid 47 is energized, the hook 46 rotates in the clockwise direction, by which the projection 41*c* is locked at its right side. When the solenoid 47 is deenergized, the hook 46 rotates in the counterclockwise direction to be released from the projection 41*c*. When the lever 16 is operated to rotate the sensor lever 36*b* in the counterclockwise direction to such an extent that the lower limit sensor 49 is interrupted, and when the arm 42 is lowered simultaneously against the upward urging force, the left side of the lever 41 is lowered, so that the lever 44 is released from the locking portion 41*e* of the lever 41, and the upper conveying roller 40*b* lowers by its weight together with the lever 44 to be press-contacted to the lower conveying roller 40*a*.

An inlet guide 49 (FIG. 9) for limiting the thickness of the set of sheet materials 2 is rotatably supported on a pin 49*a* fixed on the apparatus to be rotatable in the clockwise direction. A conveying tray 50 (FIG. 9) is closely downstream of the die 10. A ring inlet guide 51 is effective to prevent disturbance of leading edges of the sheet materials 2 coming thereto. The guide 51 is rotatably supported on a pin 51*a* fixedly mounted on the apparatus.

Referring to FIG. 1, 10, 11, 12, 13 and 14, the ring opener 7 will be described. Upper pawls 52 are extended in a horizontal plane in the form of a comb, and they have inclinedly bent up ends. The upper pawls 52 are vertically guided by the insides of the side walls of the main assembly 7*a* of the ring opener. The upper pawls 52 are driven by a motor 55 through a gear train 53. A number of lower pawls 56 are projected up inclinedly, and they have end portions extending perpendicularly to the conveyance direction of the sheet materials 2. The lower pawls 56 are driven by a motor 59 through a gear train 57. A ring 6 which is a binding member having one spine and a number of lateral fingers bent into substantial circles are set on the upper pawls 52 at its fingers. The sensor lever 60 rotatably mounted on a shaft 60*a* and normally urged in the clockwise direction, is rotated in the counterclockwise direction by the distance corresponding to an outside diameter of the ring 6. Below the sensor lever 60, a plurality of ring sensors 61 are disposed along a line to detect the presence of the ring 6 and the size of the ring 6.

Figure 13:
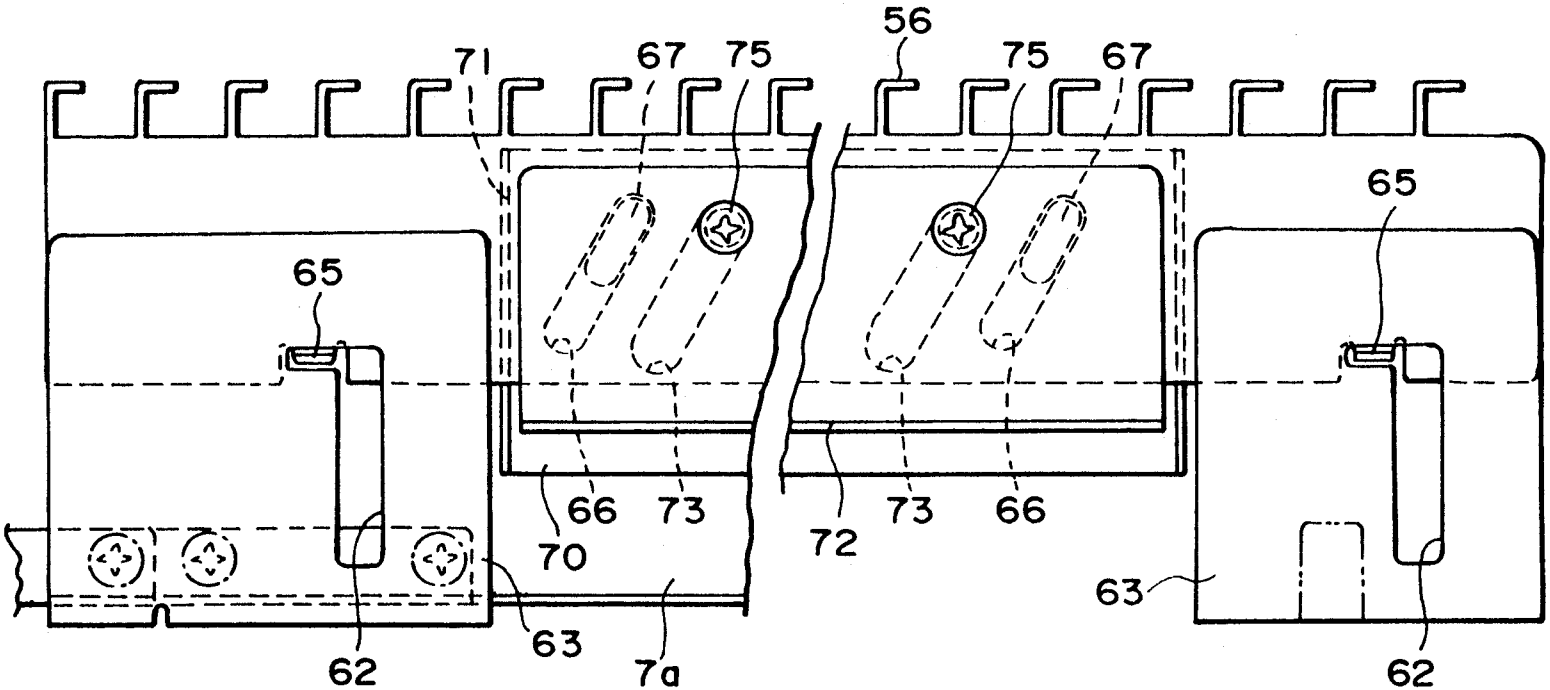
FIG. 13 is an enlarged front view illustrating a lower pawl operating mechanism.
Figure 14:
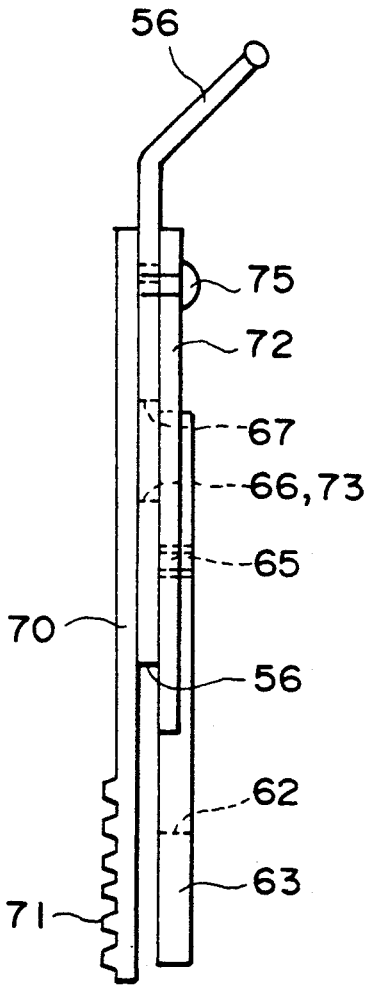
FIG. 14 is an enlarged side view of the puncher in a manual mode.

Further referring to FIGS. 13 and 14, an operating mechanism for the lower pawl 56 will be described in detail. FIG. 13 shows a front view, and FIG. 14 shows a side view, of the operating mechanism. A guide plate 63 is provided with a groove 62 at insides of both sides of the lower pawls 56. The groove 62 has horizontal and vertical portions. The guide plate 63 is mounted on the ring opener main assembly 7*a*. Projections 65 of the plate having the lower pawls 56 are guided along the groove 62. At the middle of the lower pawls 56, a pair of slanted grooves 66 is formed. A slanted projection 67 slidingly guided by the slanted slot 66 is formed on a driving plate 70 which is vertically movable. The driving plate 70 is supported for vertical movement on the ring opener main assembly 7*a*. The driving plate 70 is provided with a rack 71 which is in meshing engagement with an end gear of the gear train 57. At the front side of the lower pawls 56, a confining plate 72 is provided, and the confining plate 72 and the driving plate 70 are fixed by screws 75 penetrating a slanted loose groove 73 of the member having the lower pawls 56.

Figure 2A:
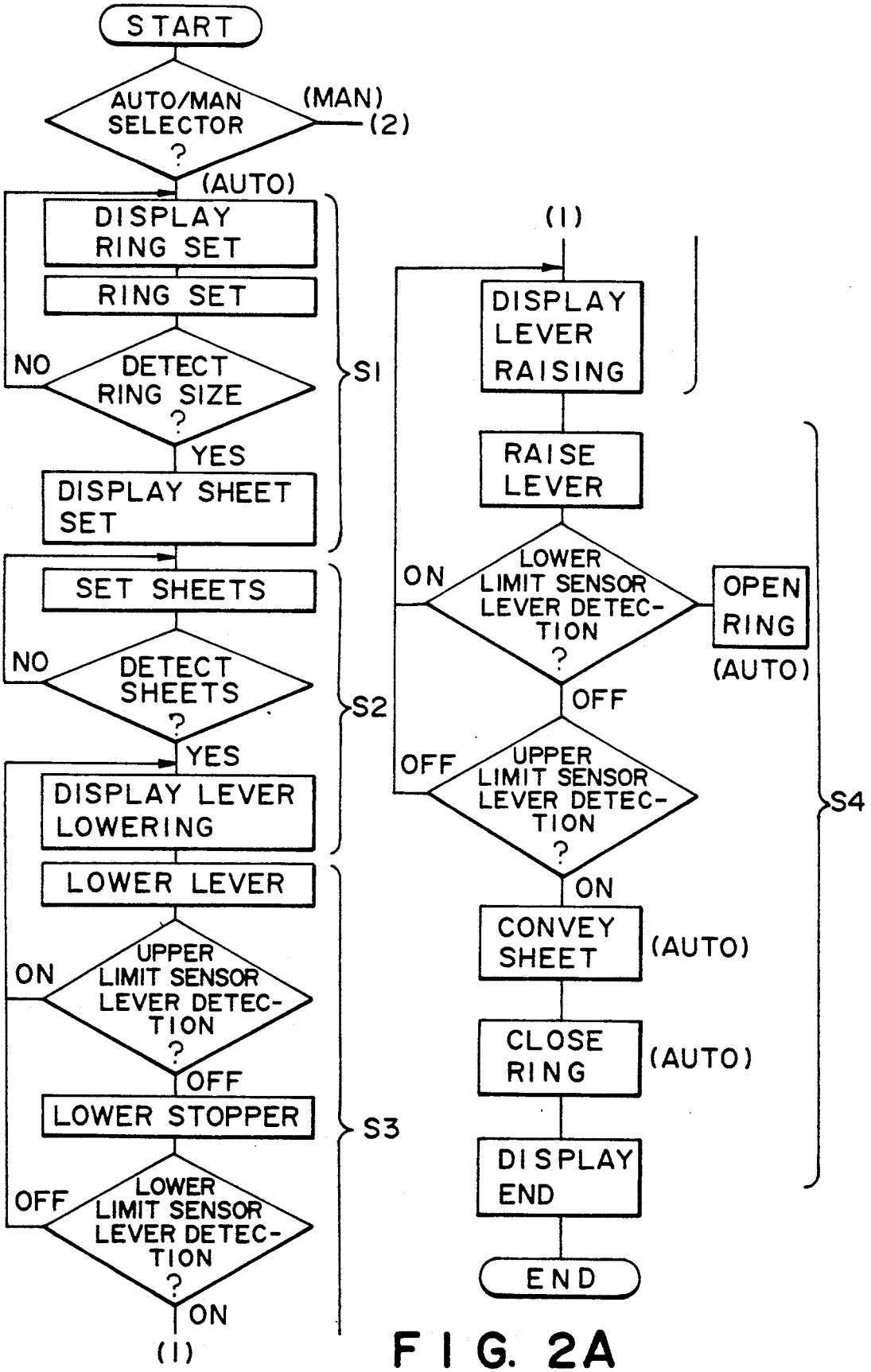
FIGS. 2A and 2B are flow charts illustrating operation of the apparatus.
Figure 3:
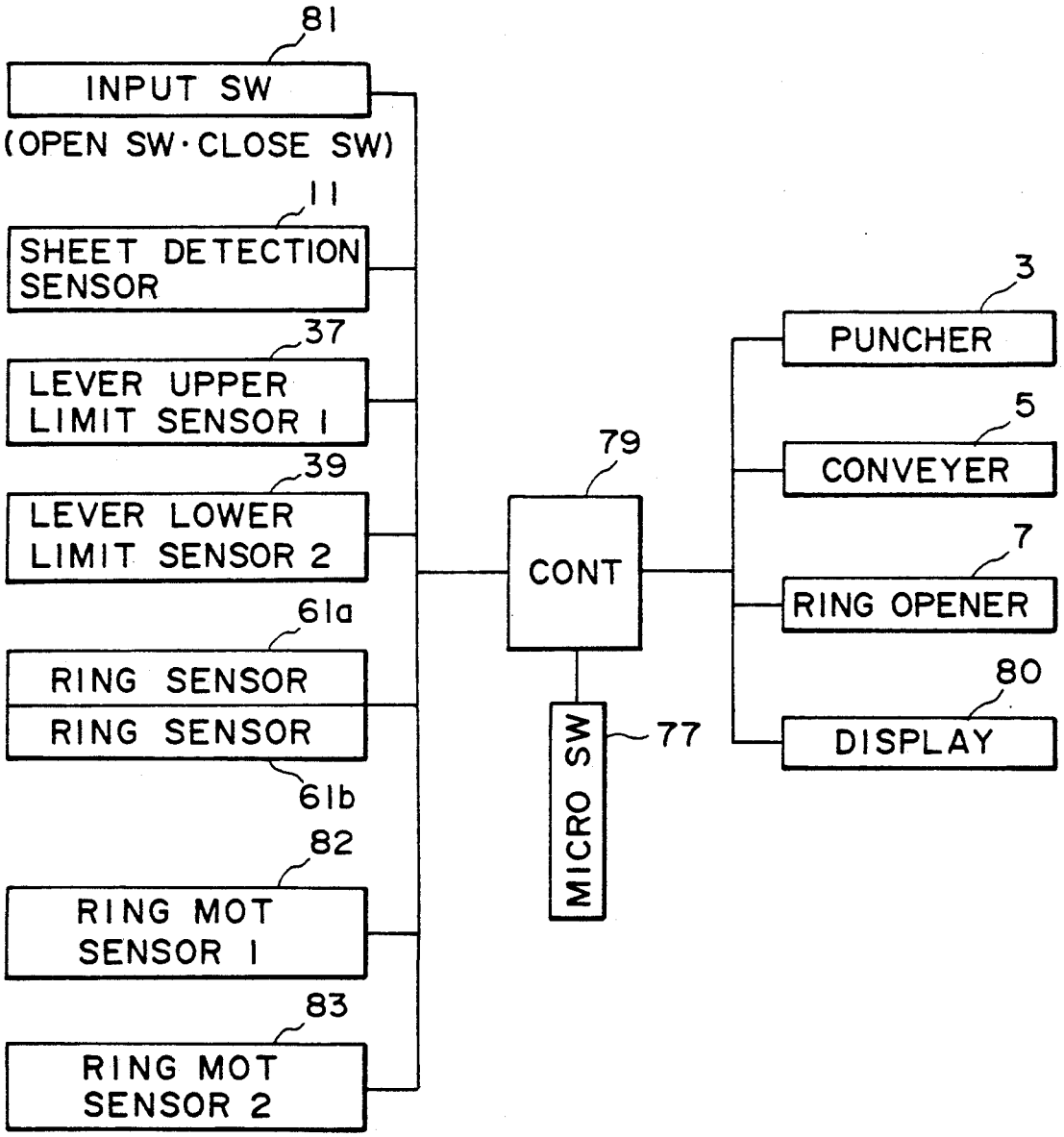
FIG. 3 is a block diagram illustrating a control system of the apparatus.

Referring to FIG. 2A and 3, the operation of the apparatus constructed in the manner described above will be described. In FIG. 2A, an automatic mode is selected, and a switch 81 is actuated. When the fingers of the ring 6 are set on the upper pawls 52, the sensor lever 60 rotates in the counterclockwise direction about the shaft 60*a*. In response thereto, the controller 79 receives from the sensors 61*a* and 61*b* a signal representing a size of the ring 6 and a signal representing the presence of the ring 6. The controller 79 transmits a signal to a display 80 to display a message that the sheets are to be set (S1).

At this time, the controller 79 selectively actuates the solenoid 13*a* or 13*b*, in accordance with the size of the ring 6 detected so as to project the stopper 12*a* or 12*b* through the hole 10*b* of the die 10. Then, the sheets are inserted until they are stopped by the stopper 12*a* or 12*b*. Then, the controller 79 receives a signal from the sensor 11, and a message is displayed on the display 80 that the lever is to be lowered (S2). Then, the operator lowers the lever 16. When the upper limit sensor 37 is deactuated by the disappearing of the sensor lever 36*a*, a signal indicative of that event is transmitted to the controller 79. Then, the elevated one of the solenoids 13*a* and 13*b* is lowered to lower the stopper 12*a* or 12*b*. Simultaneously, the pushing arm 29 is lowered by the lever arm 30, by which the sleeve 23 lowers against the spring forces by the compression springs 27*a* and 27*b*, by which the confining plate 26 integral with the pushing rods 25 presses the set of sheet materials 2. The lowered confining plate 26 is locked by the pawls 31*a* of the locking plate 31. Simultaneously, the punches 17 are lowered to punch the set of sheet materials on the die 10. Simultaneously, the pick-up arm 42 is lowered by the sensor lever 36*b* against the upward urging force. Then, the pick-up lever 41 lowers, and the upper conveying roller 40*b* and the lever 44 presses downwardly the set of sheet materials 2 by the weight thereof. Simultaneously, the controller 79 receiving a signal from the lower limit sensor 39 now actuated deenergizes the solenoid 47, upon which the lever 41 is locked through the core rod 47*a*, a locking portion 46*a* of the hook 46 and the projection 41*c*, and also a message indicative that the lever is to be raised is displayed on the display 80 (S3).

In this case, if the bottom surface of the confining plate 26 is pressed to the set of sheet materials 2 before the punching edges of the punches 17 reach the set of sheet materials 2, the sheet materials 2 are confined before the start of the punching action, so that the possible disturbance (misalignment) of the sheet materials 2 can be prevented. This can be accomplished by adjusting the compression springs 27*a* and 27*b*. Even if the confining plate 26 is pressed to the sheet materials 2 earlier, an excessive compression force to the pushing rods and the sleeves 23 can be avoided by the provision of the compression springs 27*a* and 27*b*.

When the lever 16 is raised to such an extent that the sensor lever 36*b* deactuates the lower limit sensor 39, the controller 79 receives a signal indicative of this event, upon which the controller 79 opens the ring 6. On the other hand, when the sensor lever 36*a* actuates the upper limit sensor 37, the punches 17 have been retracted by the lever 16 through the pressing arm 29. With a delay from completion of the retraction of the punches 17 from the sheet materials 2, the locking plate is rotated by the upward movement of the pressing arm 29, in the counterclockwise direction about the pin 32 through the arm 35 and the releasing link 33, upon which the confining plate 26 is released from the pawl 31*a*, upon which the confining plate 26 is moved away from the sheet materials 2.

Figure 12:
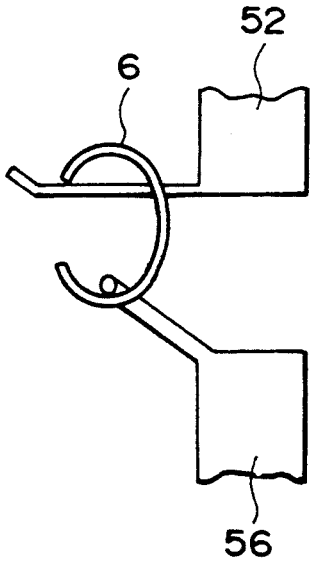
FIG. 12 is a side view wherein the binding member is opened.

The controller 79 receiving the actuation of the upper limit sensor 37 produces signals for actuating the stepping motor 8 for driving the conveying rollers 40*a* and 40*b*. The sheet materials are conveyed to the ring opener 7 by the conveying rollers 40*a* and 40*b* through a distance corresponding to a predetermined number of pulses. During the movement, the leading edges of the sheet materials 2 are prevented from being disturbed, by the inlet guide 51. The set of sheet materials is stopped at a proper position relative to the ring 6 which is opened as shown in FIG. 12, and thereafter, the ring 6 is closed.

The controller 79 receiving a signal representative of the stepping motor 8 stop produces a signal for deenergizing the solenoid 47, upon which the projection 41*c* is disengaged from the engaging portion 46*a*, and the upper conveying roller 40*b* is raised by the urging force by the tension spring 41*d* through the engaging portion 41*e* of the lever 41 and through the lever 44. After the ring 6 is closed, the display indicative of the completion of the binding operation is made on the display 80. This is the end of the binding operation (S4). After the completion, the operator pulls the bound sheet materials 2 in the direction opposite to the setting direction. At this time, the ring inlet guide 51 and the inlet guide 49 (FIG. 9) rotate in the clockwise direction so as not to impede the pulling action.

Referring to FIGS. 13 and 14, the operation of the lower pawls 56 will be described. The rack 71 is lowered by the motor 59 through the gear train 57 shown in FIG. 1. Then, the driving plate 69 lowers along the guiding plate 70. The slanted projection 67 of the guiding plate 70 applies a rightward force component to the lower pawls 56 through the slanted groove 66 in FIG. 13. By this, the projections 65 of the lower pawl 56 assembly are guided along the horizontal portions of the groove 62 of the guiding plate 63 to be moved rightwardly, by which the lower pawls 56 become engageable with the fingers of the ring 6. Subsequently, they are guided by the vertical portions of the groove 62 by the downward component force, by which the lower pawls 56 lower to open the fingers of the ring 6 downwardly. When the rack 71 is pressed upwardly by the motor 59, the lower pawls 56 move downwardly on the contrary. The confining plate 78 is integral with the driving plate 69 by the screws 75 to always retain the lower pawls. Therefore, the screws 75 make the same movement as the slanted projection 67. In consideration of this, a slanted loose hole 73 similarly to the slanted groove 66 is formed in the lower pawl 56 assembly.

In the foregoing embodiment, the bound sheet materials 2 are manually pulled out in the direction opposite to the sheet setting and conveyance direction. However, the bound sheet materials 2 may be automatically retracted by reversely rotating the motor 8 for driving the conveying rollers 40*a* and 40*b* when the completion of the binding operation is displayed on the display 80 without deenergizing the solenoid 47. By doing so, the labor for the binding operation can be saved, and the working period can be saved, too.

Referring to FIG. 1, 2B, 15 and 16, the manual mode will be described. At the bottom right side of the main assembly 7*a* of the ring opener, pins 76 are provided to rotatably support the main assembly 7*a* on the bed 1*a*, and a microswitch 77 is provided which produces a signal when the main assembly 7*a* is inclined and then fixed. The apparatus is provided with a ring opening button and a ring closing button. The inclining and fixing mechanism for the main assembly 7*a* may be in a rail-stopper type or a magnet attraction type.

Figure 2B:
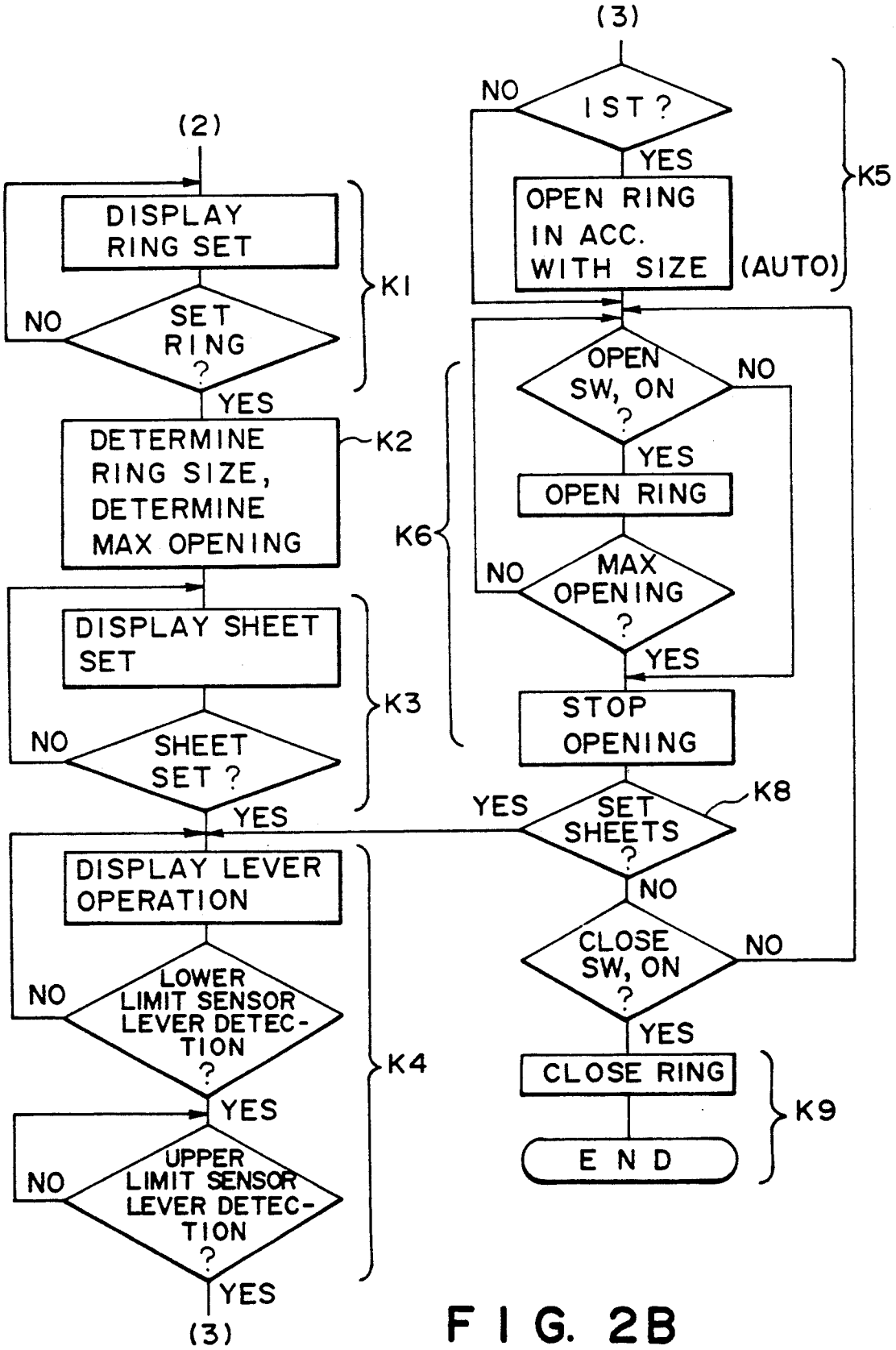

Referring to FIG. 2B, the operation of the apparatus in the manual mode will be described.

Figure 15:
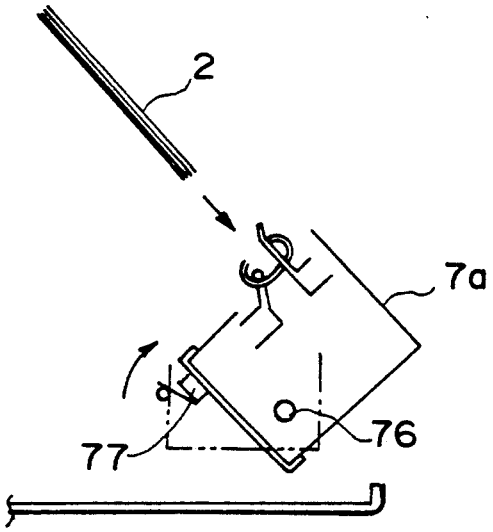
FIG. 15 is a side view of the puncher in the manual mode.

As shown in FIG. 15, the pins 76 rotatably support the main assembly 7*a* of the ring opening 7 on the bed 1*a*, as described above. When the main assembly 7*a* is inclined and fixed, the microswitch 77 is actuated to produce a signal. Receiving the signal, the controller 79 switches the control system to a manual mode. The steps K1, K2 and K3 from the ring 6 set to the sheet set are similar to those in the automatic mode described in the foregoing. That is, either one of the stoppers 12*a* and 12*b* is raised in accordance with the size of the ring 6. In step K4, together with the lowering of the lever 16, the confining plate 26 is pressed to the set of the sheet materials 2. The confining plate 26 is locked in response to the detection by the lower limit sensor, and the confining plate 26 is released upon the detection by the upper limit sensor. However, the conveying rollers 40*a* and 40*b* do not rotate. Step K5 is omitted. In step K6, the ring opening button is depressed to open the ring 6 to the extent corresponding to its size. At this time, the punched set of sheet materials 2 is inserted to the opened ring 6 shown in FIG. 16B. When the insertion is completed, the ring is maintained opened. When additional sheet material or sheet materials 2 are to be bound together, the sheet material 2 is set at step K8, and the steps K4 and K6 are executed. At step K9, the ring closing button is actuated to close the ring 6. This is the end of the operation. The number of the sheet adding operations is not limited to two, but may be larger according to the size of the ring 6.

Figures 16A, 16B:
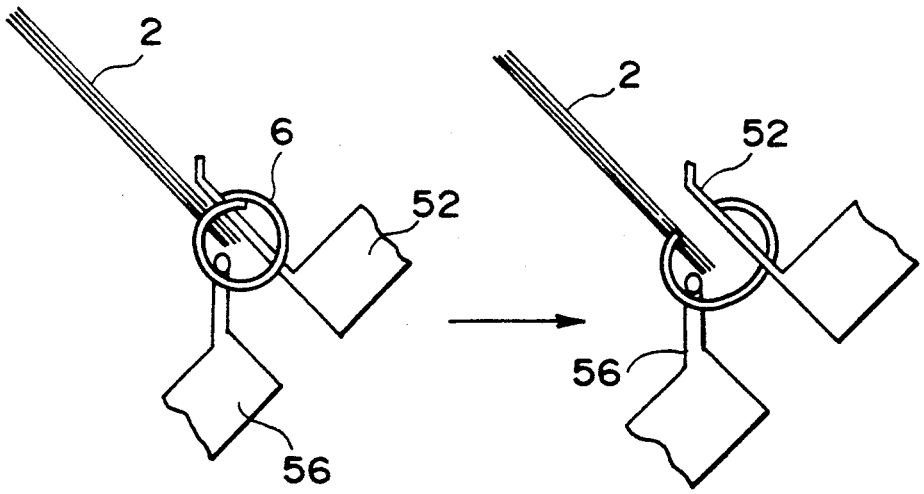
FIGS. 16A and 16B show side views of a binder in a manual mode.

When the bound sheet material or sheet materials 2 are to be exchanged, the ring opening button is actuated at step K6, and all or part of the bound sheet materials 2 are exchanged, and the steps K8, K4 and K6 are executed while the ring 6 is kept opened. The operation ends through the step K9. FIG. 16A shows the state in which the ring 6 is closed.

The reason why the main assembly 7*a* is inclined and fixed is that by doing so, the operability during the adding and exchanging operations are improved. When the inclined main assembly 7*a* is returned to the original position, the automatic mode is established.

Another modification of this embodiment will be described. In the foregoing embodiment, the lever 16 for the puncher 3 is manually operated, but it may be electrically operated by which the punching power is enhanced, and the working time can be saved.

In the foregoing embodiment, the sensor is of a transparent type. However, in the case when the sensor is to be disposed at a position easily influenced by paper dust or the like, a microswitch or the like may be used to improve the reliability of operation.

Figure 17:
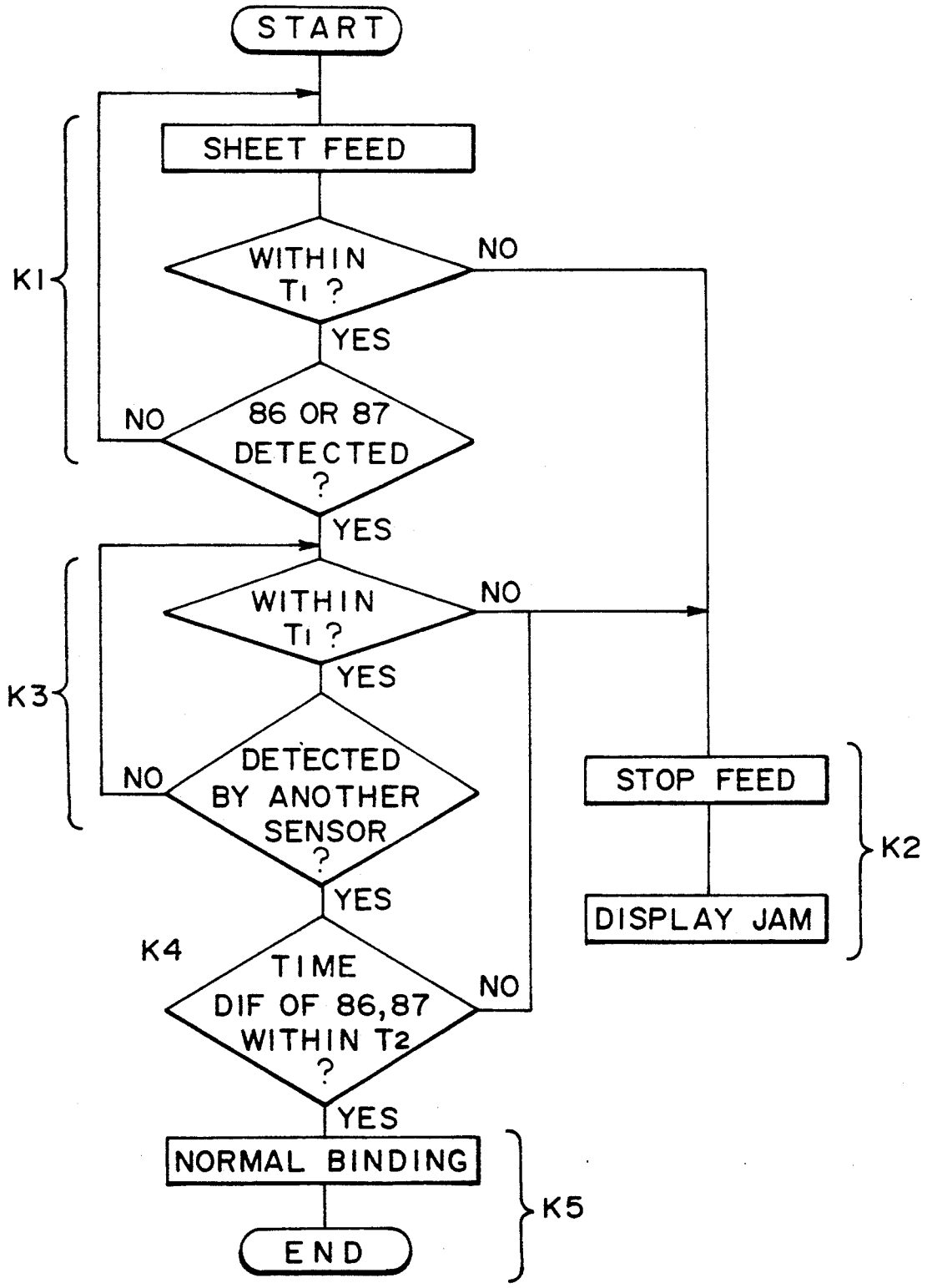
FIG. 17 is a flow chart illustrating an operation of a binding apparatus according to another embodiment of the present invention provided with inclination detecting means.
Figure 18:
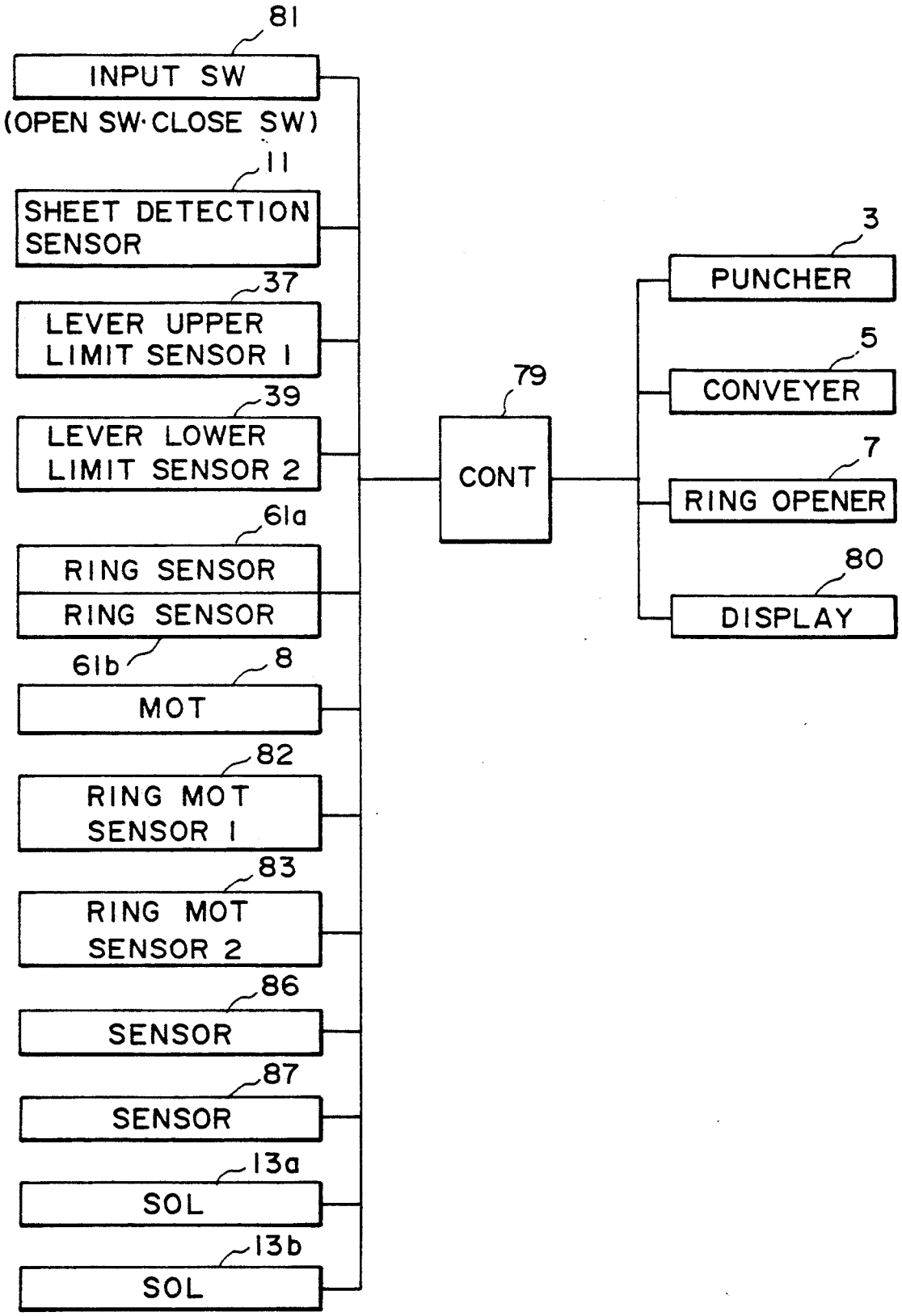
FIG. 18 is a block diagram of a control system used with the apparatus of the second embodiment.
Figure 19:
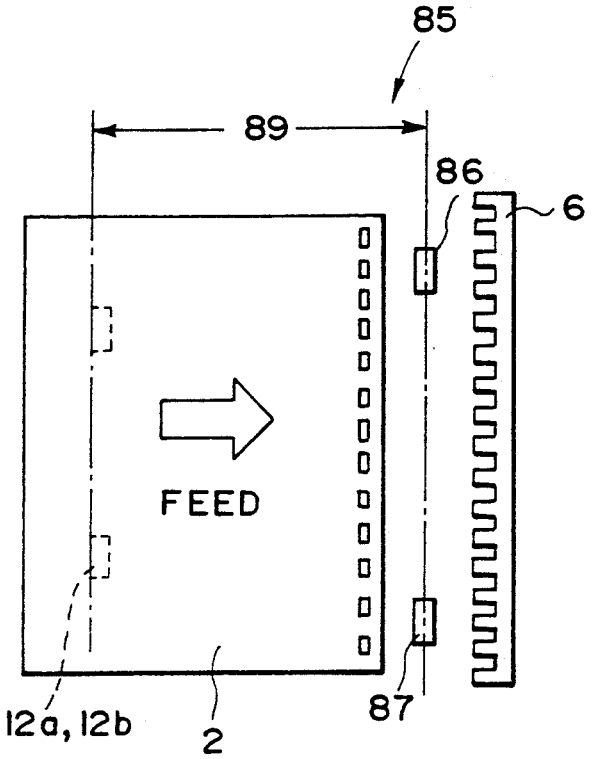
FIG. 19 is a top plan view of a jam sensor in the apparatus of the second embodiment.

Referring to FIGS. 17, 18 and 19, a second embodiment of the present invention will be described wherein the apparatus is provided with means for detecting oblique conveying and for detecting delay of the sheet materials, in addition to the elements of the foregoing embodiment.

The oblique conveyance detecting means 85 will first be described. Reflection type or transparent type sensors 86 and 87 for detecting edges of the sheet materials 2 are usually disposed adjacent to the ring 6 set on the upper pawls 52 and on a line extending perpendicularly to the direction of the sheet conveyance and adjacent lateral ends of the sheet materials. Designated by a reference numeral 89 is a distance between a left side surface of a stopper 12*a* or 12*b* and a sensor 86 or 87. The sensors 86 and 87 may be of a mechanically actuatable type.

Referring to FIG. 18, the operation of the detecting means will be described.

The controller 79 responds to a signal from the ring sensor 61*b* to determine the degree of opening proper to the ring 6 by comparing the paper stored in the controller 79 and the signals from the ring motor sensors 82 and 83.

The step S4 described in conjunction with FIG. 2A will be described in further detail referring to FIG. 17. A time period T1 is an upper limit of the time required for the sheet materials 2 to be conveyed through the distance 89, and the time period T2 is the upper limit of the tolerable time difference between the detections by the respective sensors 86 and 87, of the sheet materials 2. When the controller 79 receives a signal indicative of actuation of either one of the sensors 86 and 87 within the upper time limit T1 from the actuation signal of the upper limit sensor 37 (actuation of the driving motor for the conveying rollers 40*a* and 40*b*), a step K3 is executed. Further, if the actuation signal of the other sensors 86 and 87 is received by the controller 79 within the upper time limit T1, a step K4 is executed. If the controller 79 receives the actuation signals of the sensors 86 and 87 within the upper limit of the time difference T2, the step K5 is executed, and the correct binding operation is performed.

However, a step K2 is executed, if in step K1, either one of the actuation signals of the sensors 86 and 87 is not within the upper-limit time period T1, if in step K3, the other actuation signal is not within the upper limit, either, or if in step K4, the actuation signals of the sensors 86 and 87 are not within the upper limit time difference T2. Then, the controller 79 transmits a signal to a conveyer 51 to stop the apparatus, and the occurrence of a jam is displayed on the display 80. In this case, the binding operation is not carried out. The event that both of the sensors 86 and 87 fail to be actuated within the upper limit time T1, means that the sheet materials 2 do not come to the sensors 86 and 87 within the tolerable upper limit T1, that is, sheet jam. The time difference between the actuation signals of the sensors 86 and 87 results from oblique conveyance of the sheet materials 2. If the time difference exceeds the tolerable time difference T2, the ring 6 will be aligned only partially with the sheet materials 2. In those cases, the conveyer 5 is stopped, and the binding operation is not carried out.

In this embodiment, the time periods to be compared with the upper time limit T1 and the upper limit of the time difference T2 or the like are determined, using a timer or the like in the controller 79. Alternatively, when a stepping motor is used for driving the conveying rollers 40*a* and 40*b*, the same detections are possible by counting the numbers of the pulses. As for the delay jam, the controller 79 discriminates the occurrence of the jam if the sensors 86 and 87 do not detect the sheet materials 2 within an upper limit number of pulses P1. Similarly, as regards the oblique jam, the controller 79 discriminates the occurrence of the jam if the difference in the numbers of pulses between the sensor 87 detection and the sensor 88 detection exceeds the upper limit of the pulse number difference P2.

According to the second embodiment having the structures shown in FIGS. 17–19, when the degree of the inclination of the sheet materials during the conveyance to the binding means is larger than the upper tolerable limit, the conveying means is stopped, and the binding means is not operated. Therefore, the inconvenience that only a part of the binding member is aligned with a part of the sheet materials can be avoided, and therefore, the reliability of the operation of the apparatus can be improved.

In addition, if the delay of the sheet material in the conveying operation of the sheet materials to the binding means exceeds the upper tolerable limit, the conveying means is stopped, and the binding means is not operated, and therefore, the reliability in the operation of the apparatus can be improved.

Figure 20:
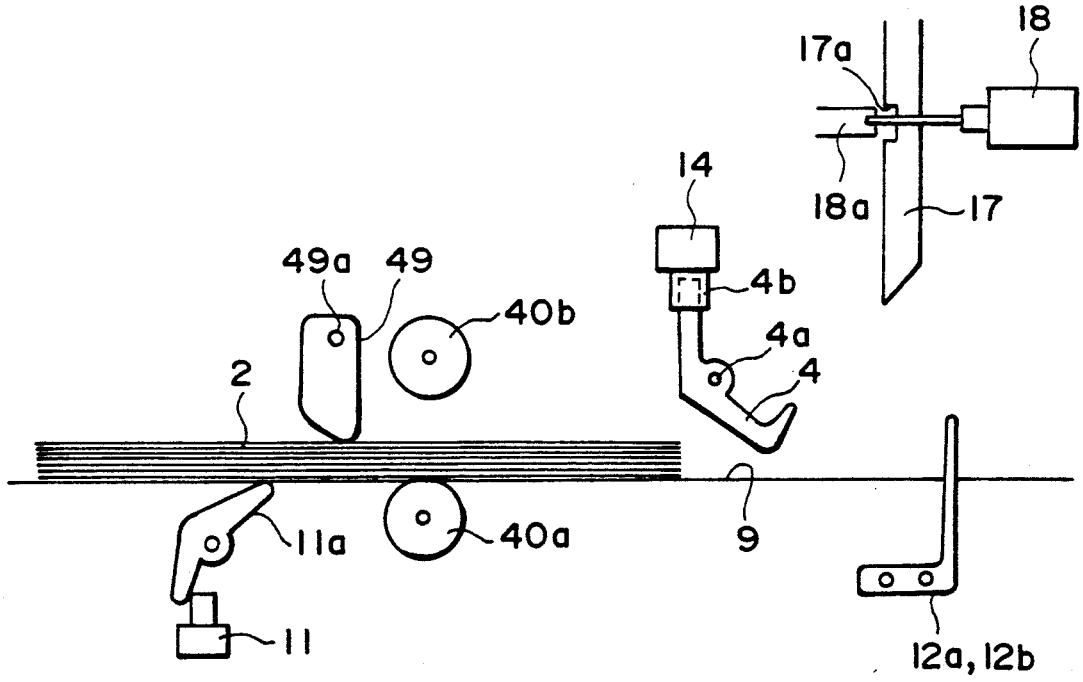
FIG. 20 illustrates punch preventing means in an apparatus according to a third embodiment of the present invention.
Figure 21:
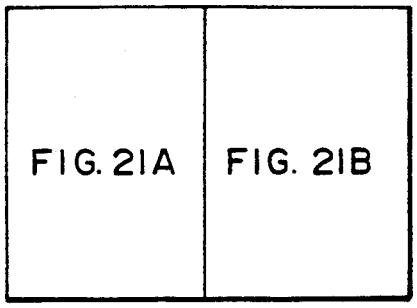
FIGS. 21A and 21B show a flow chart illustrating an operation of the apparatus of the third embodiment.
Figure 21A:
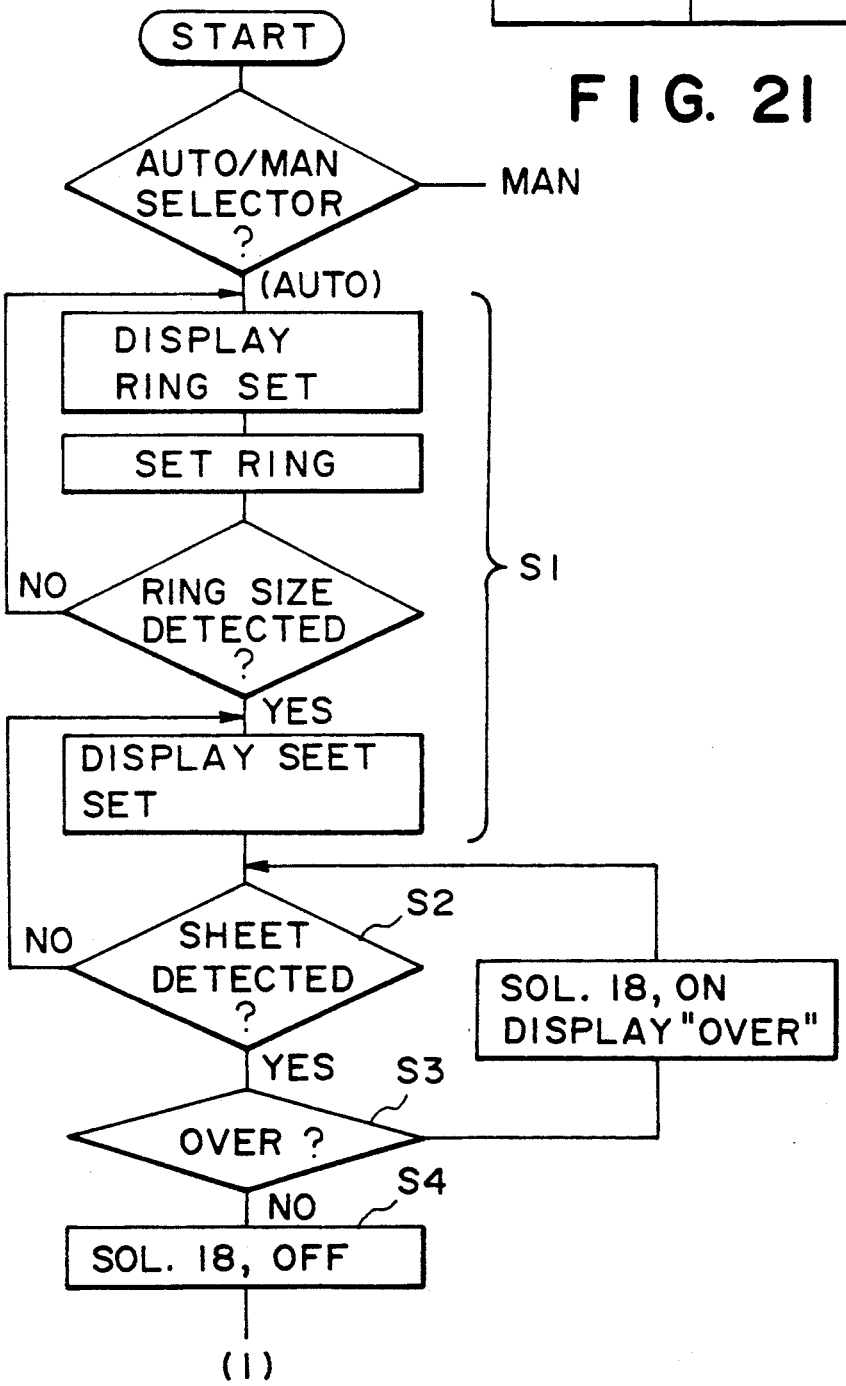
Figure 22:
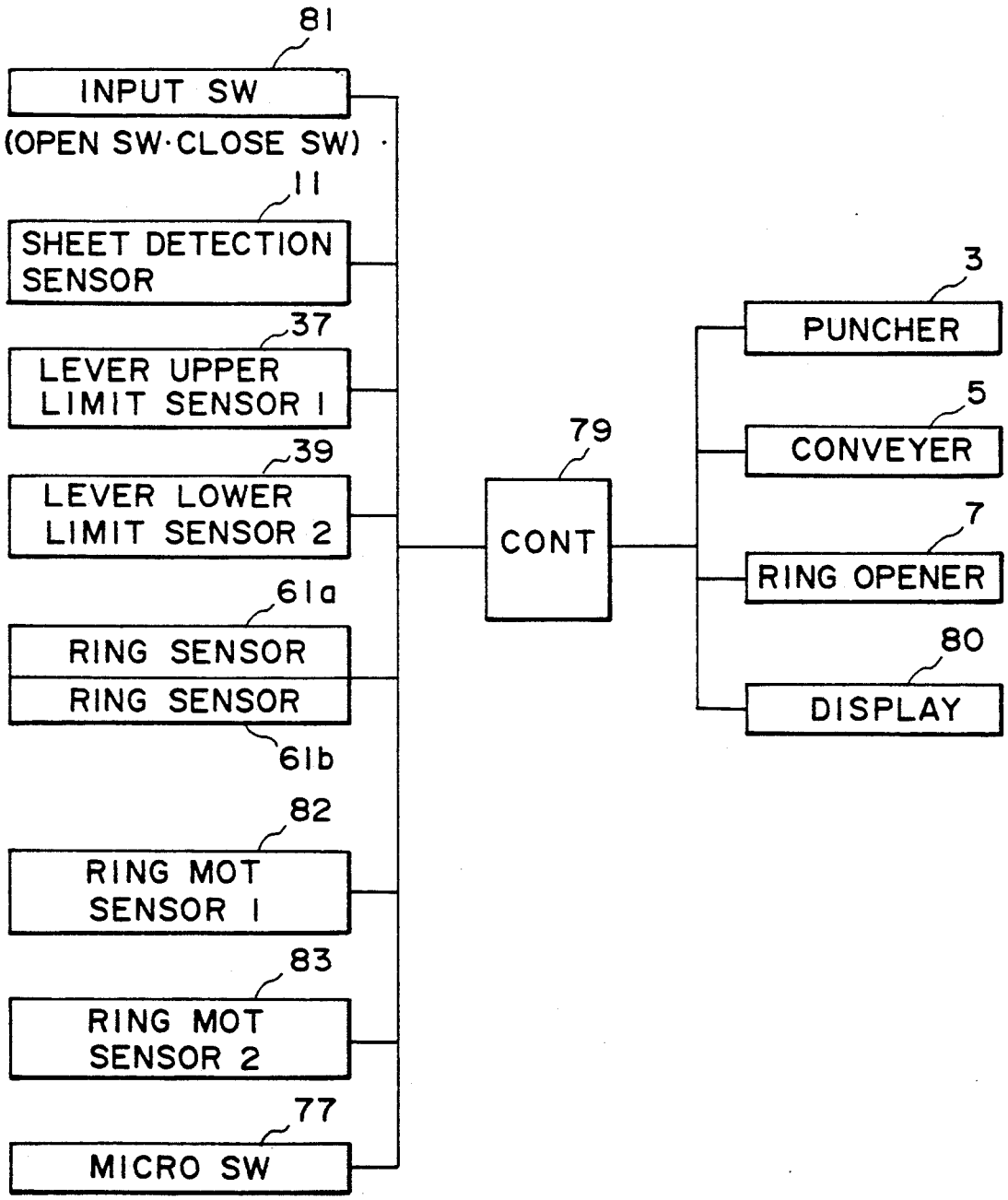
FIG. 22 is a block diagram of a control system for the apparatus according to the third embodiment.

Referring to FIGS. 20, 21 and 22, an apparatus according to a third embodiment of the present invention will be described, wherein detecting means for detecting a thickness of a set of sheet materials and punch preventing means are provided, in addition to the elements of the first embodiment (FIGS. 1–16).

Referring to FIG. 21, an automatic mode is selected, and a switch 81 is actuated at step S1. Then, a message promoting the operator to set the ring 6 is displayed. When the fingers of the ring 6 are set on the upper pawls 52, the sensor lever 60 rotates in the counterclockwise direction about a shaft 60*a*. Then, the controller 79 discriminates the size of the ring 6 by combinations of "on" and "off" of the plural sensors 61 aligned along a line actuated by the bottom of the ring sensor lever 60. Also, the setting of the ring 6 is discriminated thereby, upon which a message promoting the setting of the sheet materials is displayed on the display 80. At this time, the controller 79 energizes selectively the solenoid 13*a* or 13*b* in accordance with the detected size of the ring 6 to selectively project the stopper 12*a* or 12*b* through the hole 10*b* of the die 10.

In step S2 the sheet materials 2 are detected, and then the step S3 is executed in which the discrimination is made as to whether the thickness of the set of the sheet materials 2 exceeds the upper limit or not, using the sensor 14 (FIG. 20). If so, the solenoid 18 is actuated to engage the horizontal shaft 18*a* into the cut-away portion 17*a* of the punch 17, thus locking the punch 17, by which the operator is prevented from erroneously lowering the lever 16. Simultaneously, the overloading of the sheet materials 2 is displayed. And the operation returns to the step S2. Thus, the operator is prompted to take the sheet materials 2 out, and to insert a proper number of sheet materials 2.

If the discrimination at the step S3 is negative, that is, if the thickness is within the tolerable range, a step S4 is executed wherein the solenoid 18 is deenergized to release the punch 17, and the lowering operation of the lever 16 is displayed to promote the operator to do so.

Next, a step S5 is executed. When the lever 16 is lowered to such an extent that the upper limit sensor 37 is deactuated by the disappearing of the sensor lever 36*b*, the controller 79 receiving the signal indicative of that event produces a signal for lowering the raised one of the solenoids 13*a* and 13*b* to lower the raised one of the stoppers 12*a* and 12*b*. Simultaneously, the pressing arm 29 is lowered by the lever arm 30, by which the sleeve 23 lowers against the forces by the compression springs 27*a* and 27*b*, and the confining plate 26 integral with the pushing rod 25 presses to the set of sheet materials 2. The lowered confining plate 26 is locked with the pawl 31*a* of the locking plate 31. Simultaneously, the punches 17 are lowered to punch the set of sheet materials 2 on the die 10. Further simultaneously, the pick-up arm 42 is pressed downwardly by the sensor lever 36*b* against the upward urging force. Together with this, the pick-up lever 41 is lowered to press down the set of sheet materials 2 by the lever 44 and the upper conveying roller 40*b* by the weight thereof. The controller 79 receiving the actuated lower limit sensor 39 produces a signal for energizing the solenoid 47 to lock the lever 41 through the core rod 47*a*, the hook 46 and the engaging portion 46*a*, and in addition, the controller 79 produces a signal for making a display for promoting the raising of the lever 16 in the display 80.

At this time, if the bottom surface of the confining plate 26 is pressed to the set of sheet materials before the punching edges of the punches 17 reaches the set of sheet materials, the set of sheet materials 2 is confined earlier than the start of the punching action of the punches 17, so that the disturbance of the set of the sheet materials 2 can be prevented. This can be accomplished by adjusting the compression springs 27*a* and 27*b*. Even if the confining plate 26 confines the sheet materials 2 earlier, application of excessive compression force to the pushing rod 25 and the sleeve 23 can be prevented by the compression springs 27*a* and 27*b*.

Next, the step S6 is executed. The lever 16 is raised to such an extent that the sensor lever 36*b* deactuates the lower limit sensor 39. The controller 79 receives a signal indicative of this event, and produces signals to the drivers of the motors 55 and 59 to open the ring 6 and retain it opened to an extent meeting a signal from the sensor 61 relating to the size of the ring 6 produced as a result of communication with the signals from the ring motor sensors 82 and 83. On the other hand, if the sensor lever 36*a* actuates the upper limit sensor 37, the punches 17 have been retracted by the lever 16 through the pressing arm 29.

With a delay from the completion of the retraction of the punches 17 from the sheet materials 2, the locking plate rotates in the counterclockwise direction about the pin 32 by the upward movement of the pressing arm 29 through the arm 35 and the releasing link 33, and the confining plate 26 is released from the pawl 31*a*, so that the confining plate 26 is moved away from the set of sheet materials. The controller 79 receiving the actuation signal of the upper limit sensor 37 produces a signal for driving the stepping motor 8 for driving the conveying rollers 40*a* and 40*b*. Then, the sheet materials are conveyed to the ring opener by the conveying rollers 40*a* and 40*b* through a distance corresponding to a predetermined number of pulses. During the conveyance, the leading edges of the sheet materials 2 are not disturbed because of the provision of the ring inlet guide 49. The sheet materials are detected by an unshown sensor disposed below the conveying table 50. Thereafter, the sheet materials are stopped at a proper position relative to the opened ring 6 shown in FIG. 12. Thereafter, the ring 6 is closed. The controller 79 receiving the signal from an unshown sensor produces a signal to deenergize the solenoid 47, by which the upper conveying roller 41*b* is raised by the urging force of the pick-up arm 42. After the ring 6 is closed, the end of a binding operation is displayed on the display 80. This is the end of the binding operation. The operator manually pulls the bound sheet materials in the direction opposite to the setting of the sheet materials. At this time, the inlet guide 49 and the ring inlet guide 51 rotate in the clockwise direction so as not to obstruct the pulling action.

Next, the manual mode will be described. As shown in FIG. 15, by inclining and fixing the main assembly 7*a* of the ring opener 7, the manual mode shown in FIG. 21 is established. More particularly, an actuation signal of the microswitch 77 is produced, which is received by the controller 79, which in turn is switched to the manual mode. In the manual mode, the conveyer 5 is disabled, and the other parts are operable as in the automatic mode.

The operation of exchanging the bound sheet materials 2 or the operation of adding sheet materials to the bound sheet materials 2, for example, is executed in the state of the apparatus shown in FIG. 16B described hereinbefore. Since the apparatus is inclined and fixed in this manner, the operator can easily operate and observe the apparatus.

The detection of the thickness of the set of sheet materials 2 can be performed in either of the automatic and manual modes. In this embodiment, the thickness of the set of sheet materials 2 is made by a combination of a mechanical contact 4 and a photointerruptor sensor 14. Alternatively, an arm rotatable in accordance with the thickness and a variable resistor at the center of the arm may be used to detect the thickness depending on the change of the resistance. In addition, the light emitting and light receiving elements may be independent.

Another alternative is that when a set of sheet materials 2 having a thickness exceeding the level set in the punching station, the interruption sensor 14 detects it, and the controller 79 receiving the signal transmits a signal to the display 80, so that a message prohibiting the punching operation is displayed.

According to the third embodiment described in conjunction with FIGS. 20, 21 and 22, when a set of sheet materials having a thickness exceeding a predetermined level is inserted into the punching means, the detecting means detects the event, and the punching operation is prohibited by punching operation prohibiting means, and therefore, the operator is prevented from punching too many sheet materials. Thus, the damage of the apparatus, and the damage to the sheet materials can be prevented beforehand, and therefore, a binding apparatus which is very easy to operate can be provided.

By employing as the punching prohibiting means the punch locking means, the error of attempting to punch very thick sets of sheet materials can be completely removed.

By the punch prohibiting means displaying the prohibition, the operator can be notified of the punch prohibition by a simple structure.

The fourth embodiment will be described wherein the sheet materials having been bound are automatically taken out, in addition to the elements of the first embodiment described in conjunction with FIGS. 1–16.

Figure 23A:
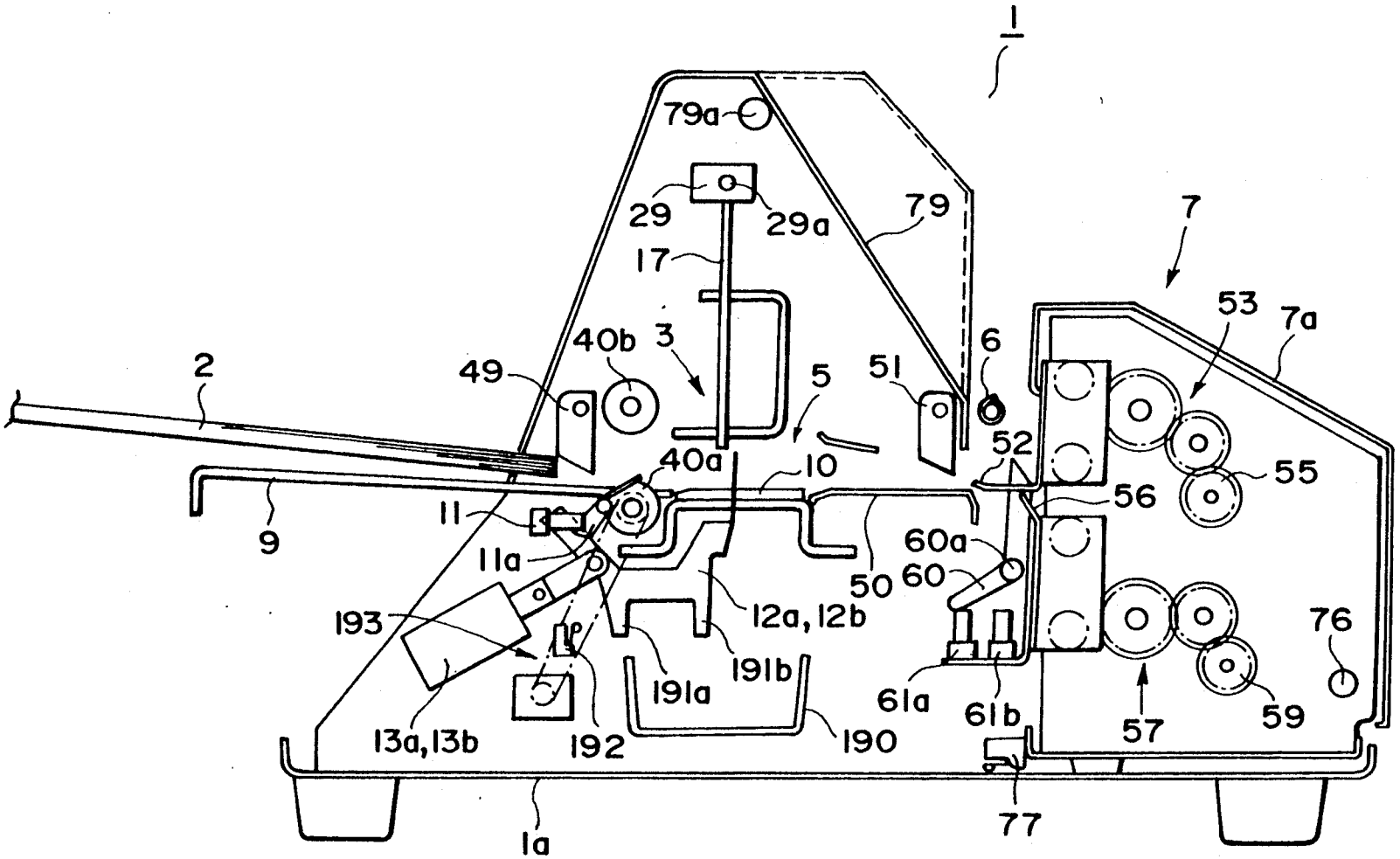
FIG. 23A is a sectional view of a binding apparatus according to a fourth embodiment of the present invention.

Referring to FIG. 23A, an automatic sheet material binding apparatus 1 comprises a punching station 3 for punching the set of sheet materials, a conveyer 5 for conveying the punched set of sheet materials 2 and a ring opener 7 for opening and closing the ring 6 to bind the sheet materials conveyed by said conveyer 5. This is the same as the structure of FIG. 1.

As additional elements, projections 191*a* and 191*b* projecting downwardly are provided on the stoppers 12*a* and 12*b*, and a punch fragment container 190 is disposed below the projection 191*b*. When the solenoid 13*a* or 13*b* is actuated, the projection 191*b* enters the top middle portion of the container 190. A stopper detecting switch 92 is provided. When the top end of the stopper 12*a* or 12*b* is disposed slightly below the top surface of the die 10, and the bottom end of the projection 191*b* projecting downwardly, of the stoppers 12*a* and 12*b* is substantially at the top surface of the container 190, the stopper detecting switch 92 is contacted to the projection 191*a* of the stoppers 12*a* and 12*b*, by which the switch 92 is actuated. Therefore, the fragment detecting means is actuated when the stopper detection switch 92 is not actuated even after a predetermined short period elapses after the solenoid 12*a* or 12*b* is actuated, that is, after the upper limit sensor 37 is deactuated.

Figure 23B:
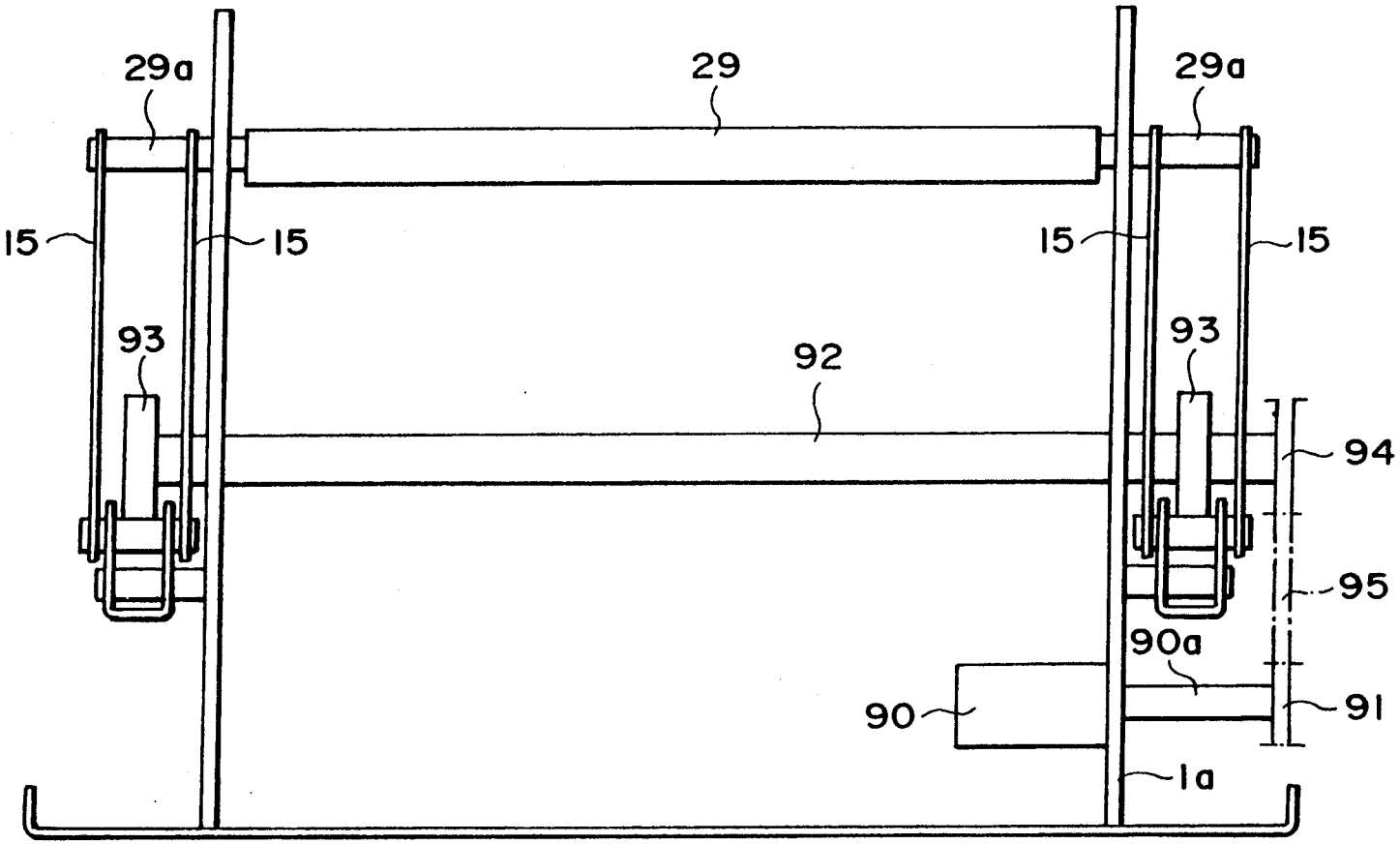
FIG. 23B is a front view of a puncher driving mechanism.
Figure 23C:
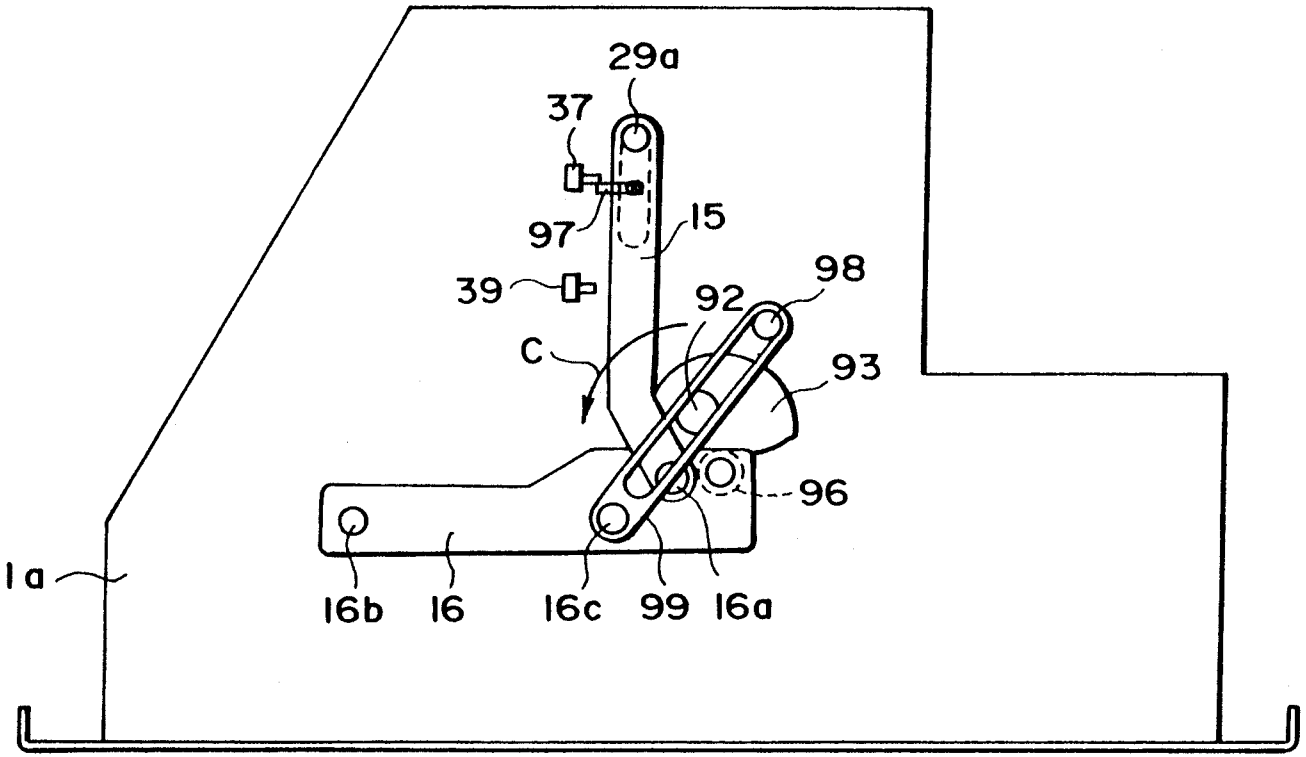
FIG. 23C is a view of the mechanism of FIG. 23B.
Figure 23D:
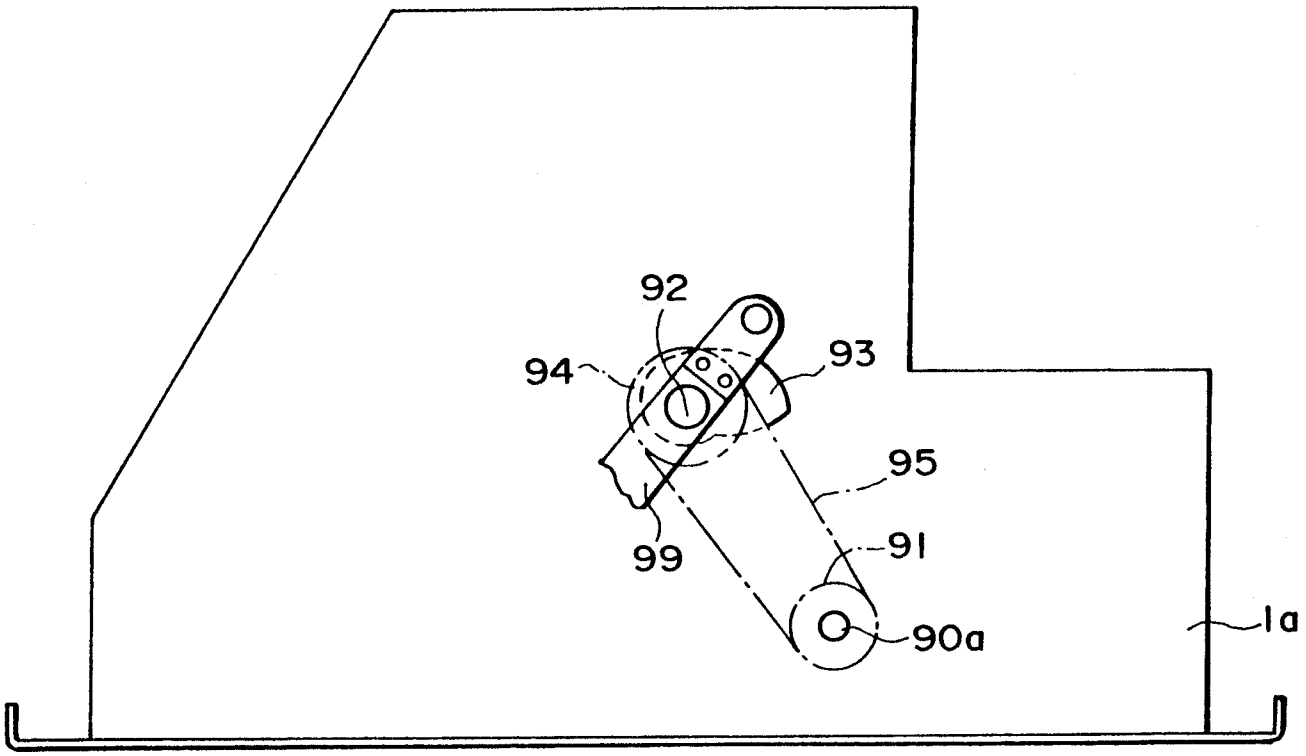
FIG. 23D side view of a cam driver.

Referring to FIGS. 23B, 23C and 23D, the structure for driving the punches 17 of the punching station 3 by a motor will be described.

To the pins 29*a* projected from the opposite longitudinal ends of the pressing arm 29 described in conjunction with FIG. 7, the upper ends of the links 15 are engaged. The bottom of the link 15 is rotatably supported to an end of the arm 16 by a pin 16*a*. The other end of the arm 16 is rotatably supported on the bed 1*a* by a pin 16*b*. To the shaft 90*a* of the motor 90 mounted on the bed 1*a*, a sprocket 90 is mounted. A cam 93 is mounted to the opposite ends of the shaft 92 horizontally and rotatably supported on the bed 1*a*. At the opposite ends thereof, a sprocket 94 is mounted to face the sprocket 91. Around the sprockets 91 and 94, a chain 95 is trained.

As shown in FIG. 23C, a roller 96 following a cam 93 is mounted to the link 15 side of the arm 16. Therefore, when the cam 93 is rotated in the direction C (FIG.

23C), and the roller 96 is pressed by the profile surface of the cam 93, the punches 17 are pushed through the link 15, shaft 29*a* and the pressing arm 29.

The profile surface of the cam 93 is such that the cam stroke increases gradually, the profile may be changed as desired in accordance with the stroke of the punches 17 and the output of the motor 90. By one rotation of the cam 93, one punching action is completed.

A sensor lever 97 is mounted on the link 15, and an upper limit sensor 37 and a lower limit sensor 39 are mounted at the upper limit position and the lower limit position of the moving stroke of the sensor lever 97. A returning member 99 is mounted between a fixed pin 98 and a pin 16*c* at the middle of the arm 15. Therefore, the punches 17 are normally urged upwardly through the arm 16, the link 15, the shaft 29*a* and the pressing arm 29.

Figure 26:
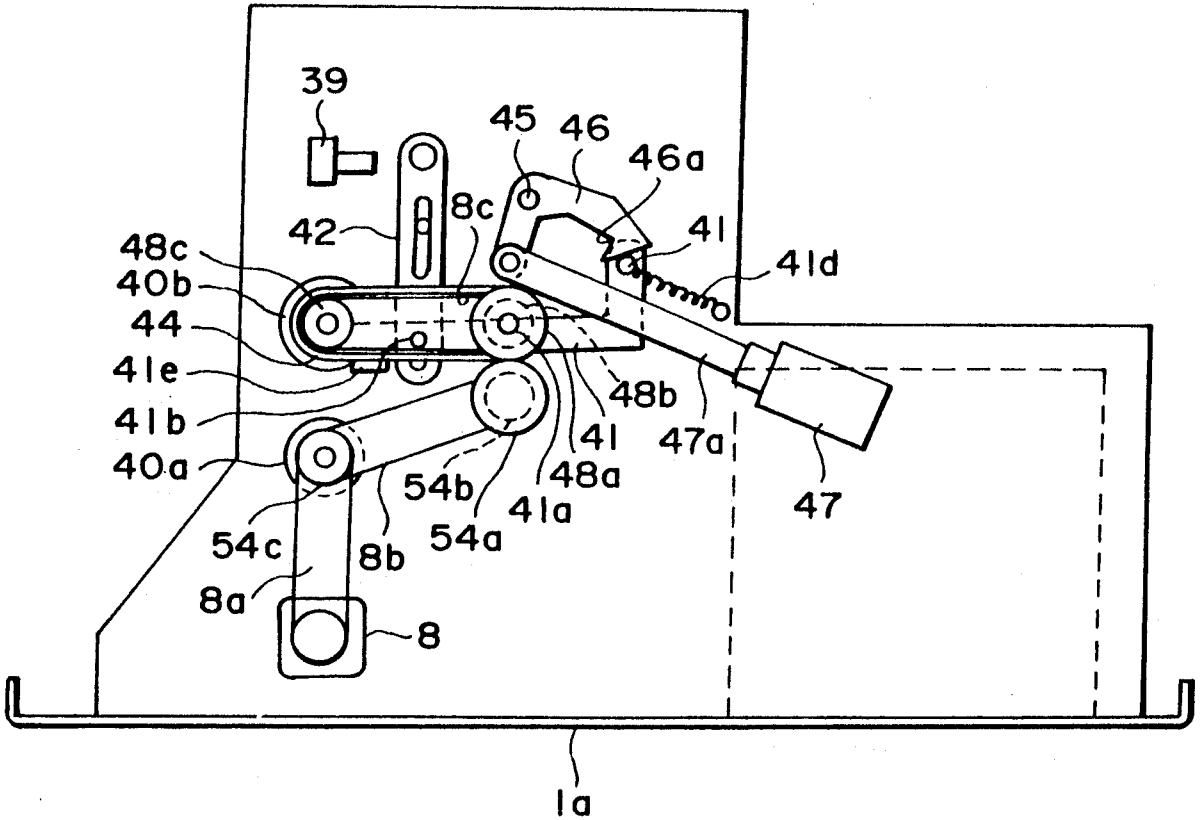
FIG. 26 is a side view of the punching station of the apparatus according to the fourth embodiment.
Figure 27A:
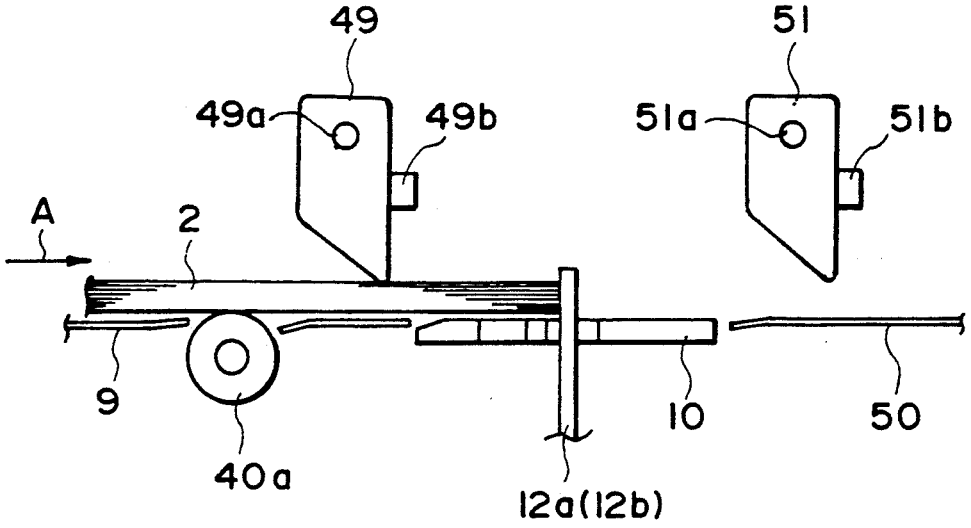
FIGS. 27A and 27B are side views of a conveyer of the apparatus according to the fourth embodiment.

Referring to FIGS. 23, 26 and 27, the conveyer 5 will be described. The conveying roller 40*a* movable from below the sheet material supporting table 9 to above the table is rotated by a motor 8 mounted on the apparatus 1 and reversely rotatable.

A hook 46 is rotatably supported on a pin 45 fixed on the apparatus. To the engaging portion 46*a* of the hook 46, a projection 41*c* of the vertical portion of the lever 41 is engageable.

An arm 42 moves vertically in interrelation with the pressing arm 29.

Figure 27B:
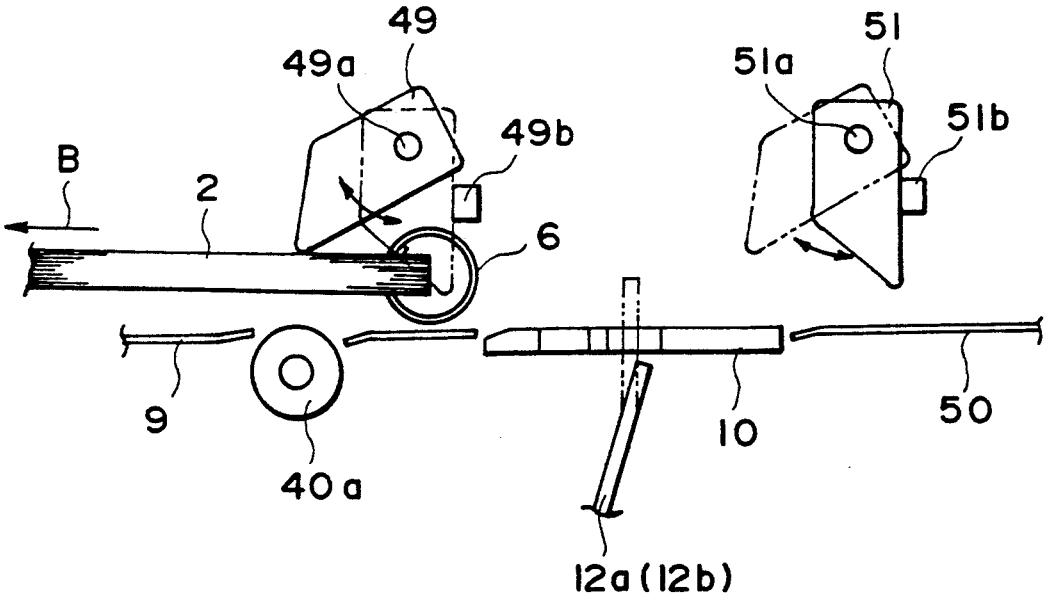

An inlet guide 49 (FIG. 9) for limiting the thickness of the set of sheet materials 2 is rotatably supported on a pin 49*a* fixed on the apparatus, and is clockwisely rotatable, but the counterclockwise rotation thereof is stopped by a stopper 49*b*. A conveying table 50 is disposed closely downstream of the die 10. A ring inlet guide 51 is effective to prevent disturbance of the leading edges of the sheet materials 2. It is clockwisely rotatably supported on a pin 51*a* fixed on the apparatus, and the counterclockwise rotation thereof is stopped by a stopper 51*b*. Regarding the movement of the sheet materials 2 in the direction A, the leading edges of the sheet materials 2 and the thickness of the set of the sheet material are limited, but when the sheet materials 2 are pulled in the direction B, the sheet materials are easily pulled out even if the ring 6 is mounted, as shown in FIG. 27B.

Figure 28:
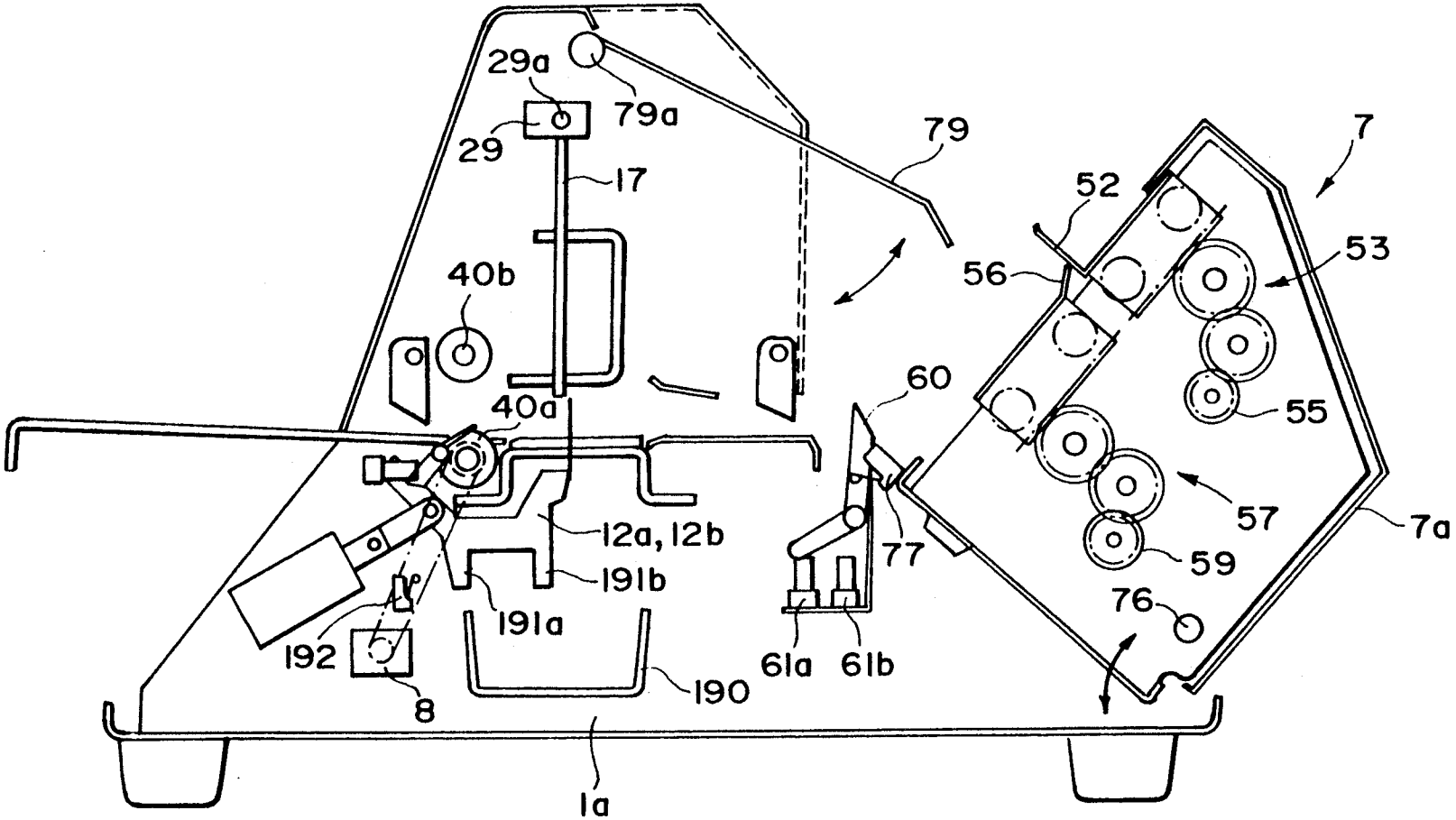
FIG. 28 is a side view of the apparatus of FIG. 23A.
Figure 29:
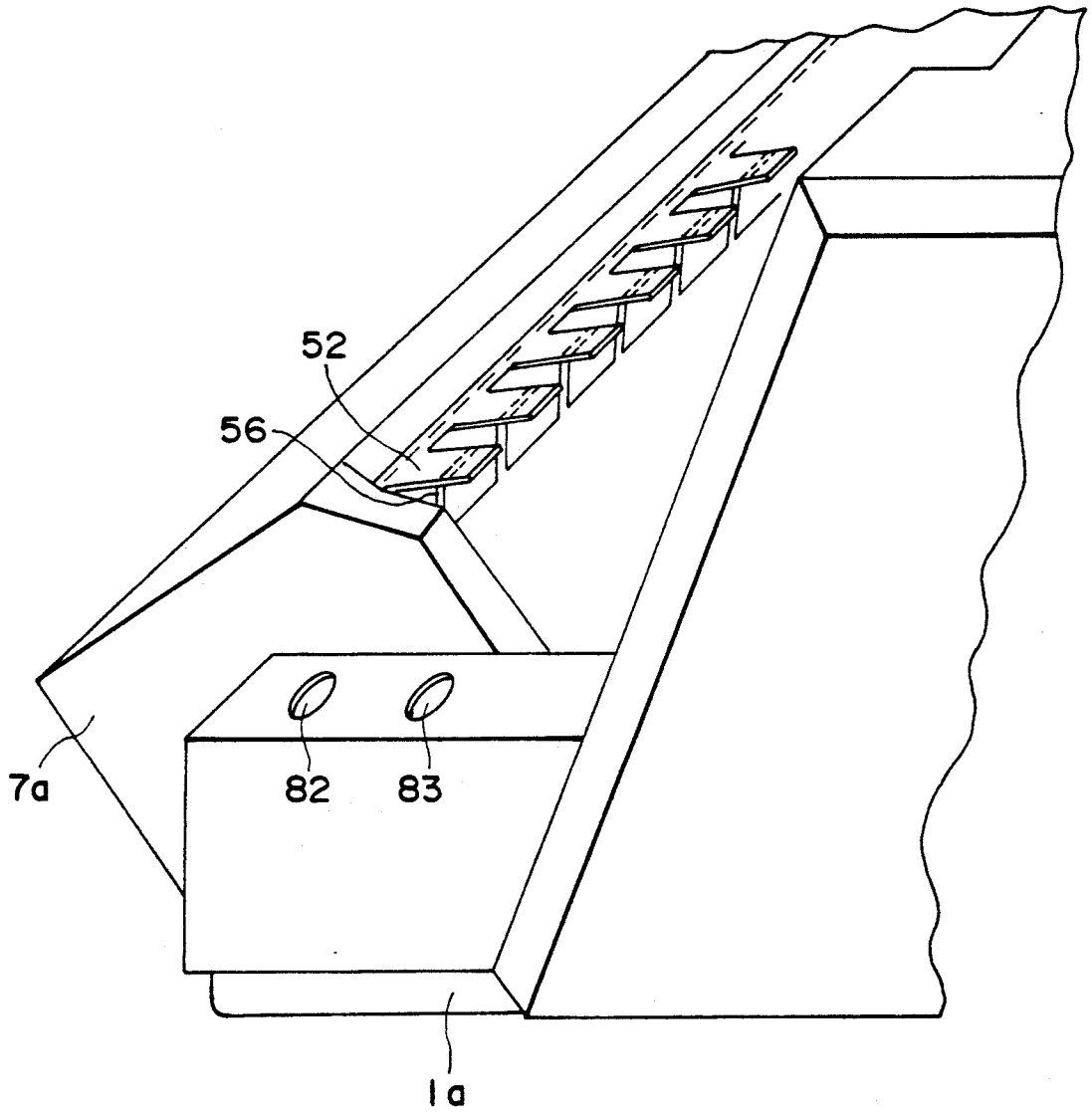
FIG. 29 is a perspective view illustrating a ring opening and closing button in the manual mode in the apparatus of the fourth embodiment.

As shown in FIG. 28, an auxiliary guide 79 rotates in the counterclockwise direction about the pin 79*a* by an unshown elastic member, when the main assembly 7*a* is inclined and fixed. This establishes a guiding surface for the sheet materials 2 in the manual mode. As shown in FIG. 29 a ring opening button 82 and a ring closing button 83 are mounted on a bed 1*a* of the apparatus 1.

Figure 24:
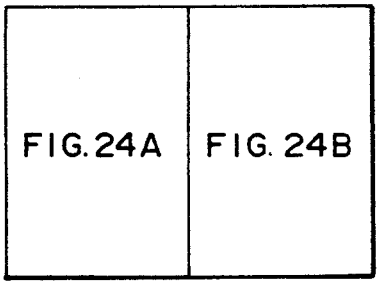
FIGS. 24A and 24B show a flow chart illustrating an operation in an automatic mode in the apparatus of the fourth embodiment.
Figure 24A:
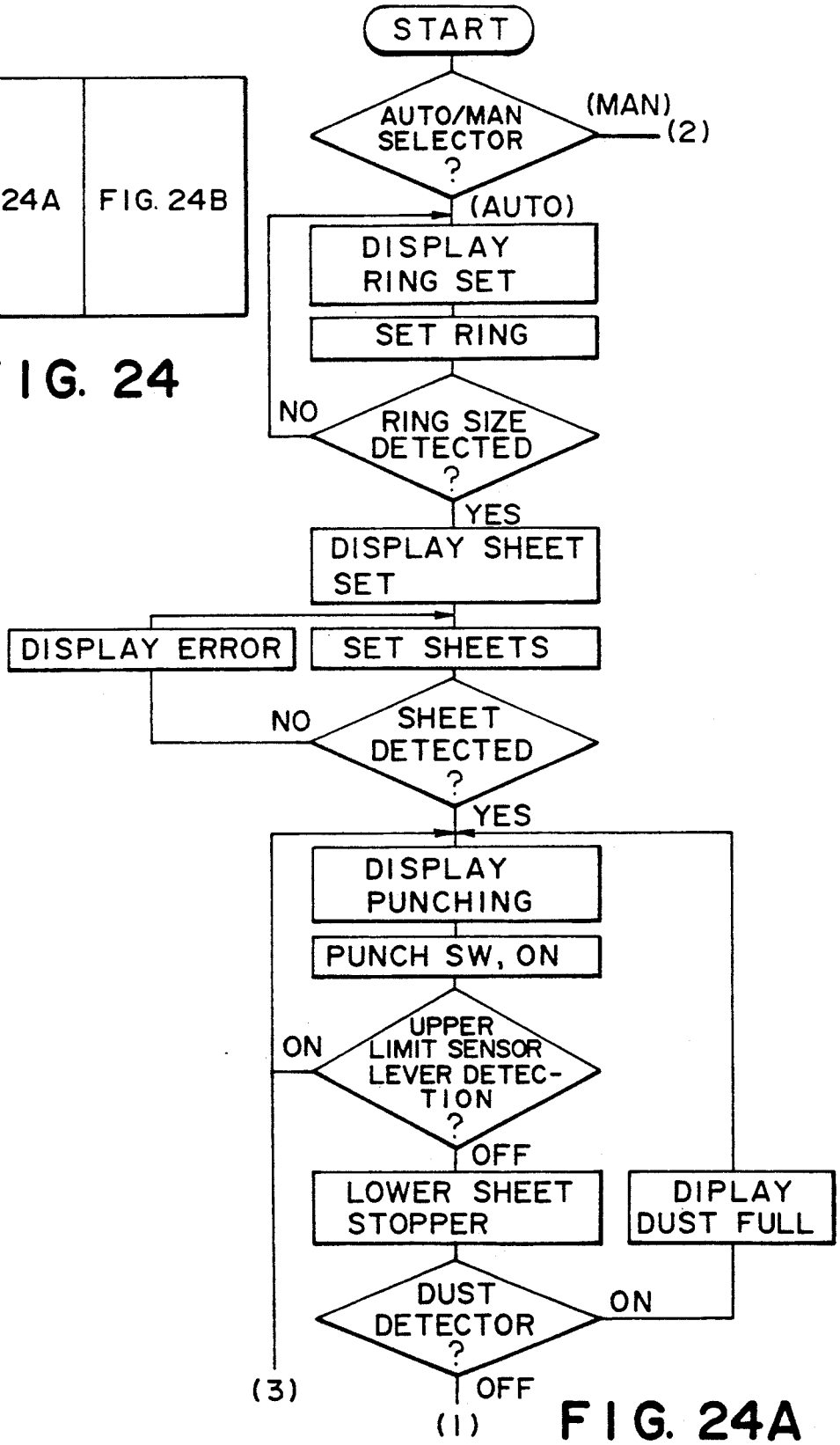
Figure 24B:
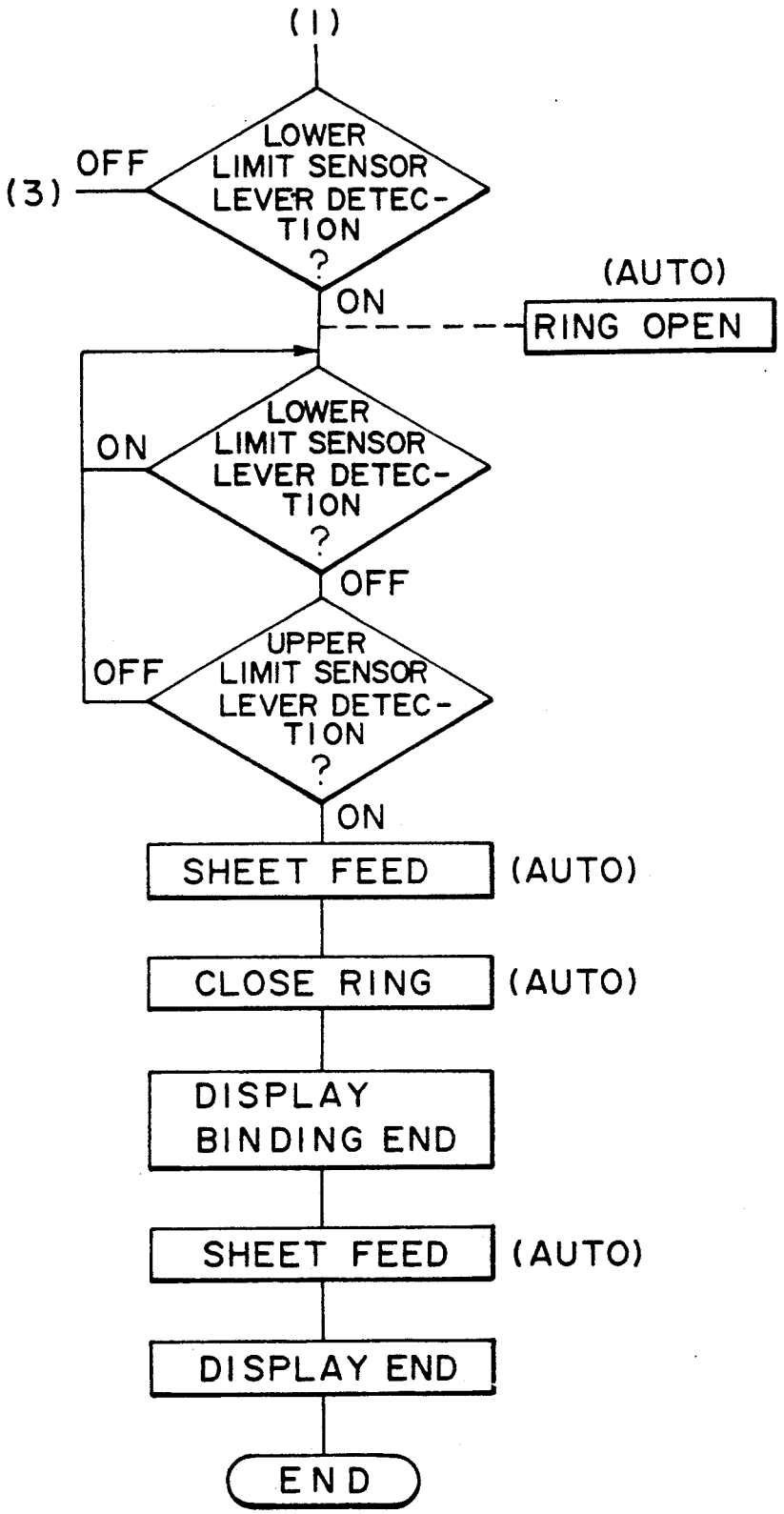
Figure 25:
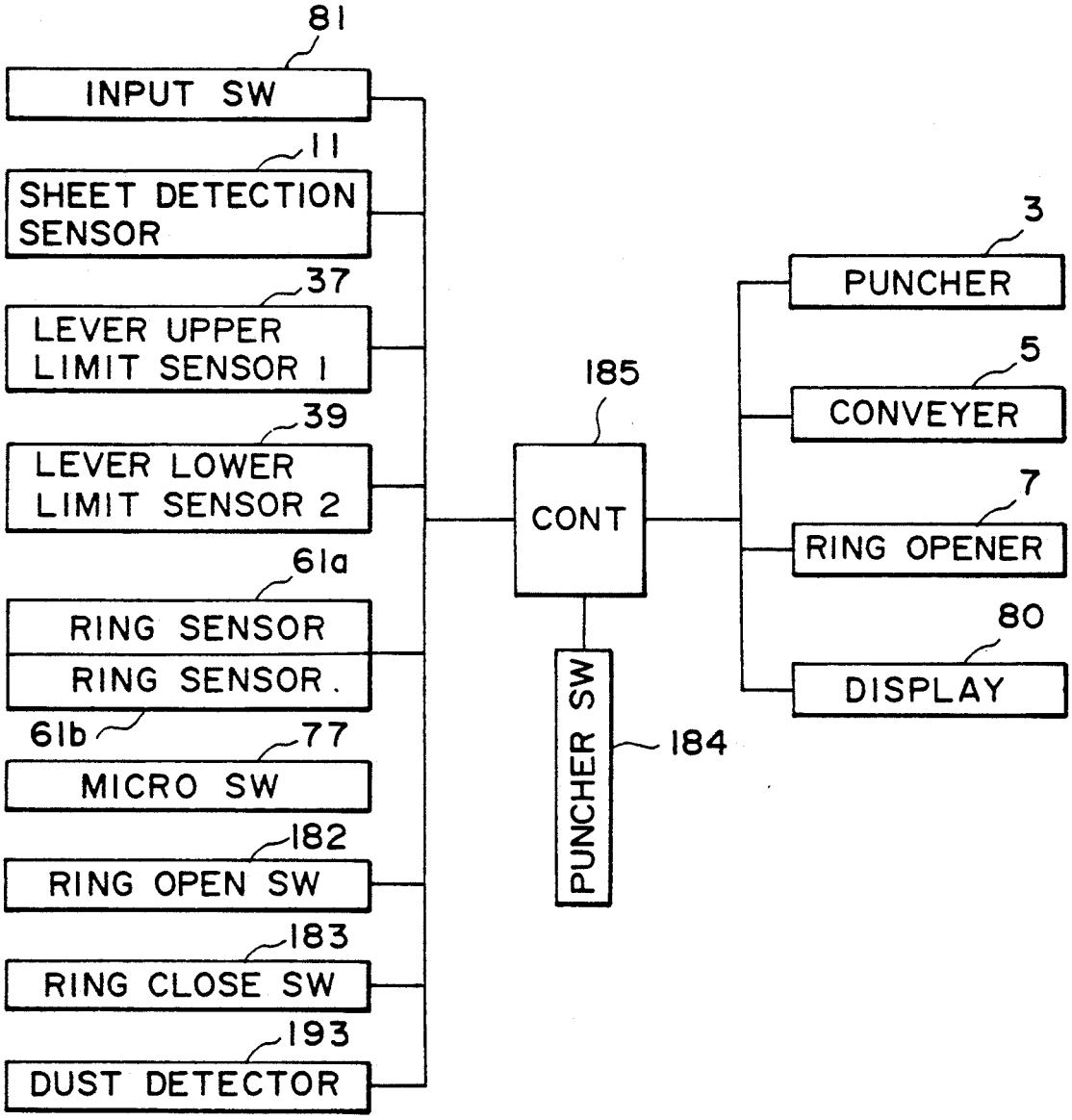
FIG. 25 is a block diagram of a control system used in the apparatus according to the fourth embodiment.

The operation of the apparatus of the fourth embodiment will be described in conjunction with FIG. 24 and 25. In FIG. 24, when an automatic mode is selected, a switch 84 is actuated. When the fingers of the ring 6 are set on the upper pawl 52, the sensor lever 60 rotates in the counterclockwise direction about the shaft 60*a*, and transmits a signal indicative of the size of the ring 6 and a signal indicative of the presence of the ring 6 from the sensors 61 and 61*b*. The controller 185 receiving the signals produces a signal for displaying the setting of the sheet materials on the display 80. At this time, the controller 185 energizes selectively the solenoid 13A or 13B in accordance with the size of the ring 6, by which stopper 12*a* or 12*b* is projected through the hole 10*b* of the die 10. Then, the sheet materials 2 are inserted until they abut the stopper 12*a* or 12*b*. The controller 185 receiving a detection signal from the sensor 11, produces a signal for displaying the punching operation to be performed. Then, the punching switch 84 is depressed, and the upper sensor 37 is deactuated by the disappearing of the sensor lever 97. The controller 185 receiving the signal produces a signal for lowering the raised one of the solenoids 13*a* and 13*b*, so that the stopper 12*a* or 12*b* is lowered.

At this time, if the container 190 is full of the punch fragments to such an extent that the top surface thereof exceeds the top of the container 190, the downward projection 191*b* does not lower to the predetermined position. That is, if the stopper detection switch 192 is not actuated even if a short period elapses after the deactuation of the upper limit sensor 37, the blank detecting means 193 is actuated. On the other hand, the punching motor 90 may continue to rotate cam 93 to complete one rotation to complete the punching action for the sheet materials 2. However, since it should be prohibited that the conveying motor 8 is actuated in response to the upper limit sensor 37 actuated again (because the stopper 12*a* or 12*b* interferes with the sheet material 2). Therefore, when the detecting means 193 is actuated, "full of punch fragments" is displayed on the display 80. In addition, at least the upper and lower limit sensors 37 and 39 are disabled. The display may also be disabled. The container 190 is taken out, and it is cleared, and then is reset in the apparatus 1 again. Then, the upper and lower limit sensors 37 and 39 and the display are reset. The operation resumes from the stage of display of the punching to be performed in the flow chart of FIG. 24.

When the container 190 is in order the following operation is effected. Simultaneously with the lowering of the stepper 12*a* or 12*b*, the pressing arm 29 is lowered by the motor 90 through the lever 15, the arm 16, the cam 93 or the like, by which the sleeve 23 is lowered against the forces by the compression springs 27*a* and 27*b*, and the confining plate 26 integral with the pushing rod 25 is pressed to the sheet materials 2. The lowered confining plate 26 is locked by the pawl 31*a* of the locking plate 31. Simultaneously, the punches 17 are lowered to punch the set of sheet materials 2 on the dye 10. Simultaneously, the pick-up arm 42 is moved downwardly against the upward urging force, and the pick-up lever 41 is lowered, by which the conveying roller 40*b* and the lever 44 presses to the sheet materials 2 by the weight thereof. The controller 185 receiving the actuation signal of the lower limit sensor 39 produces a signal for energizing the solenoid 47, by which the lever 41 is locked through the core rod 47*a* and engaging portion 46*a* of the hook 46 and the projection 41*c*, and the punch 17 is raised. At this time, if the bottom surface of the confining plate 26 is pressed to the set of sheet materials 2 before the punching edge of the punch 17 starts its punching action, the set of the sheet materials 2 is confined before the start of the punching action, and therefore, the disturbance (misalignment) of the sheet materials 2 can be prevented. At this time, the controller 185 receiving a signal indicative that the sensor lever 96 deactuate the lower limit sensor 39 produces a signal to open the ring 6. On the other hand, when the sensor lever 90 actuates the upper limit sensor 37, the punch 17 is already withdrawn. With a delay from the completion of the retraction of the punches 17 from the sheet material 2, the locking plate 31 is rotated in the counterclockwise direction about the pin 32 by the upward movement of the pressing arm 29 through the arm 35 and the releasing link 33, by which the confining plate 26 is released from the pawl 31*a*, and the confining plate 26 is moved away from the set of the sheet materials 2. The controller 185 receiving the actuation signal of the upper limit sensor 37 produces a signal to actuate the stepping motor 8 for driving the conveying rollers 40*a* and 40*b*. The sheet materials are conveyed to the ring opening 7 by the conveying rollers 40*a* and 40*b* through a distance corresponding to a predetermined number of pulses. During the movement, the ring inlet guide 51 prevents the disturbance of the leading edges of the sheet materials 2. When the sheet materials are placed at a proper position relative to the ring 6 which is opened as shown in FIG. 12 described hereinbefore, the ring 6 is closed.

When the ring 6 is closed, and the completion of the binding operation is displayed on the display 80, the controller 195 reversely rotate the motor 8 for driving the conveying rollers 40*a* and 40*b* to automatically pull the bound sheet materials 2 out. The distance of the backward conveyance can be selected by the operator who selects the number of steps for the motor 8 on the basis of the position for the operator's convenient position empirically determined. Thus, the sheet materials automatically come to the take-out position. At this time, as shown in FIG. 27B, the inlet guide 49 and the ring inlet guides 51 rotate in the clockwise direction so as not to impede the sheet materials 2 even with the ring 6. Simultaneously with the stop of the motor 8, the solenoid 47 is deenergized, by which the projection 41*c* is disengaged from the engaging portion 46*a*, and the upper conveying roller 40*b* is raised by the urging force by the tension spring 41*d* through the engaging portion 41*e* of the lever 41 and the lever 44. Simultaneously therewith, the end of operation is displayed in the display 80. The operator takes the bound sheet materials 2 out from the take-out position.

By the structure described above, the labor for the binding operation can be saved and the working time can be saved.

The description will now be made as to the manual mode. As shown in FIG. 28, the main assembly 7*a* is inclined about the pin 76 and then is fixed. Then, the microswitch 77 is actuated, and the controller 185 receiving the signal switches the control system to the manual mode. Then, the auxiliary guide 79 rotates in the clockwise direction about the pin 79*a* to support and guide the sheet materials 2 in the manual mode. The manual mode is selected in the case when the capacity of one punching action of the punches 17 is short as compared with the binding capacity of the ring 6, and the punching action is repeated to add the sheet materials to the bound ones, or in the case when the bound sheet materials are desired to be exchanged, so that only by the automatic mode, the desired operation cannot performed.

During the manual mode, the sheet material 2 are not automatically conveyed and, therefore, the ring 6 is opened or closed by actuating a ring opening button 182 and a ring opening button 183, as shown in FIG. 29. The determination of the degree of the opening is determined by the operator. Since the proper degree of the opening of the ring 6 is memorized in the controller 185 similarly to the automatic mode, the operator simply depresses a desired number of times the ring opening button 182 to obtain a desired degree of the opening. Even if the operator depresses the button too many times, the ring is not opened to a degree beyond the memorized degree. Upon the end of the operation, the ring closing button 183 is depressed to close the ring. This is the end of the operation. When the sheet material is to be added or exchanged, the sheet materials 2 are set below the upper pawls 52 as shown in FIG. 16A, and the ring opening button 182 is operated. Then, the sheet materials 2 can be freely taken out, as shown in FIG. 16B, so that the sheet materials 2 can be easily added or exchanged.

By inclining the main assembly 7*a*, the observation and operation of the apparatus are easy.

As described in the foregoing, according to the fourth embodiment described in conjunction with FIGS. 23–29, the sheet materials having been bound are automatically conveyed back (in the direction B) by the conveying means. Therefore, even if the length of the sheet materials measured along the sheet conveyance direction is the same as the distance between the sheet material insertion inlet and the binding means, or if it is smaller than it, the bounded sheet materials are retracted outside of the apparatus, so that the bound sheet materials bounded can be easily taken out. Thus, the operation efficiency of the automatic sheet material binding apparatus can be increased. In addition, the apparatus is easy to handle only by an unskilled operator.

It is possible that two or more embodiments described above are combined.

While the invention has been described with reference to the structures disclosed herein, it is not confined to the details set forth and this application is intended to cover such modifications or changes as may come within the purposes of the improvements or the scope of the following claims.

What is claimed is:

1. A sheet binding apparatus, comprising:

means for supporting a set of sheet materials;

punching means for punching the sheet materials on said supporting means;

conveying means for conveying the sheet materials punched by said punching means along a conveyance path;

binding means for binding the sheet materials conveyed by said conveying means;

control means for sequentially controlling said punching means, said conveying means and said binding means; and improper conveyance detecting means for detecting improper conveyance of the sheet materials by said conveying means along the conveyance path, wherein said control means is responsive to said improper conveyance detecting means to prohibit a normal operation of said sheet binding apparatus.

2. An apparatus according to claim 1, wherein said punching means is manually operable.

3. An apparatus according to claim 1, wherein said punching means is automatically operated by a power source.

4. An apparatus according to claim 1, wherein said conveying means, said punching means and said binding means are disposed in the order named from an upstream side with respect to a direction of sheet materials conveyance by said conveying means.

5. An apparatus according to claim 4, further comprising retractable sheet material confining means, slightly downstream of said punching means, for confining the sheet materials placed on said supporting means at a correct position.

6. An apparatus according to claim 5, wherein said conveying means includes a pair of upper and lower members, which are spaced apart when receiving the sheet materials, to permit reception of the sheet materials.

7. An apparatus according to claim 6, wherein said punching means includes punches vertically movable, and the vertical movement of the punches are detected by a sensor.

8. An apparatus according to claim 7, wherein the sensor transmits a signal to said control means to convey the sheet materials by said conveying means, after the punches are raised.

9. An apparatus according to claim 7, wherein the sensor transmits a signal to said control means to retract said confining means after the punches are lowered.

10. An apparatus according to claim 1, further comprising completion means for detecting completion of a binding operation, and in response to an output of said completion detecting means, said control means controls said conveying means to convey the bound sheet materials backwardly.

11. An apparatus according to claim 1, further comprising completion detecting means for detecting completion of a binding operation, and in response to an output of said completion detecting means, said control means controls said conveying means to be moved away from the bound sheet materials.

12. An apparatus according to claim 11, further comprising means for displaying completion of the binding operation.

13. An apparatus according to claim 1, wherein said improper conveyance detecting means comprises oblique conveyance detecting means for detecting oblique conveyance of the sheet materials, and further comprising second control means for prohibiting operation of said binding means and for stopping said conveying means in response to an output of said oblique conveyance detecting means.

14. An apparatus according to claim 1, wherein said improper conveyance detecting means comprises delay detecting means for detecting delay in the conveyance of the sheet materials, and further comprising second control means for prohibiting said binding means and for stopping said conveying means in response to an output of said delay detecting means.

15. A sheet binding apparatus, comprising:

means for supporting a set of sheet materials;

punching means for punching the sheet materials on said supporting means;

conveying means for conveying the sheet materials punched by said punching means;

binding means for binding the sheet materials conveyed by said conveying means;

control means for sequentially controlling said punching means, said conveying means and said binding means;

supporting means for supporting said binding means for movement between an automatic mode position wherein the sheet materials conveyed by said conveying means are received and a manual mode position wherein the sheet materials are not received through said conveying means; and detecting means for detecting the manual mode position of said binding means, and for prohibiting, in response to the detection of the manual mode position, sheet material conveyance by said conveying means through said control means.

16. An apparatus according to claim 15, further comprising manually operable control means for controlling said binding means.

17. A sheet binding apparatus, comprising:

means for supporting a set of sheet materials;

punching means for punching holes in the sheet materials supported on said supporting means;

conveying means for conveying the sheet materials punched by said punching means in a conveyance direction; and binding means for binding the sheet materials conveyed by said conveying means, wherein said punching means punches holes in the sheet materials at a location adjacent to leading edges of the sheet materials as they are conveyed in the conveyance direction by said conveying means, and said binding means binds the sheet materials using the punched holes.

18. An apparatus according to claim 17, wherein, after a binding operation of said binding means, said conveying means retracts the sheet materials from said binding means back toward said punching means.

* * * * *

UNITED STATES PATENT AND TRADEMARK OFFICE

CERTIFICATE OF CORRECTION

PATENT NO. : 5,152,653

DATED : October 6, 1992

INVENTOR(S) : Kazuhiro Matsuo, et al.

It is certified that error appears in the above-identified patent and that said Letters Patent is hereby corrected as shown below:

On the title page:

[57] ABSTRACT:

Line 5, "and" should be deleted.
Line 6, "conveyer;" should read --conveyer; and--.

Figure 21B:
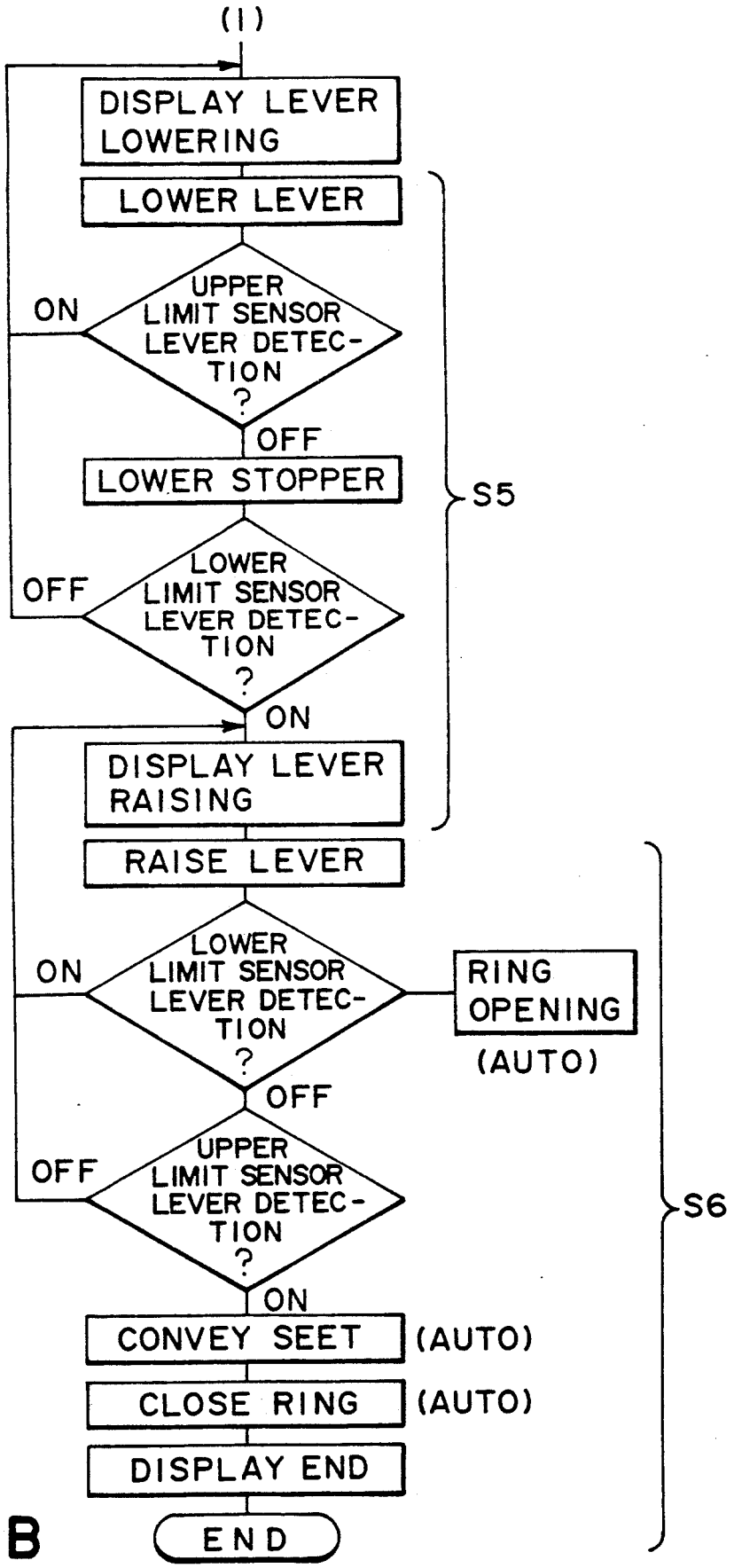

SHEET 18 IN THE DRAWINGS:

FIG. 21B, "SEET" should read --SHEET--.

COLUMN 4:

Line 29, "50" should read --so--.

COLUMN 14:

Line 35, "stepper 12a" should read --stopper 12a--.
Line 63, "lever 90" should read --lever 96--.

UNITED STATES PATENT AND TRADEMARK OFFICE

CERTIFICATE OF CORRECTION

PATENT NO. : 5,152,653

DATED : October 6, 1992

INVENTOR(S) : Kazuhiro Matsuo, et al

It is certified that error appears in the above-identified patent and that said Letters Patent is hereby corrected as shown below:

COLUMN 16:

Line 23, "bounded" should be deleted.

Signed and Sealed this

Twenty-first Day of December, 1993

*Attest:*

Bruce Lehman

BRUCE LEHMAN

*Attesting Officer*

*Commissioner of Patents and Trademarks*